US009260840B2

(12) United States Patent
Kennedy

(10) Patent No.: US 9,260,840 B2
(45) Date of Patent: Feb. 16, 2016

(54) MAIN VALVE FOR DRY BARREL FIRE HYDRANT

(71) Applicant: Kennedy Valve Company, Elmira, NY (US)

(72) Inventor: Paul Kennedy, Horseheads, NY (US)

(73) Assignee: Kennedy Valve Company, Elmira, NY (US)

( * ) Notice: Subject to any disclaimer, the term of this patent is extended or adjusted under 35 U.S.C. 154(b) by 117 days.

(21) Appl. No.: 14/317,814

(22) Filed: Jun. 27, 2014

(65) Prior Publication Data

US 2015/0376876 A1 Dec. 31, 2015

(51) Int. Cl.
*E03B 9/14* (2006.01)

(52) U.S. Cl.
CPC ..... *E03B 9/14* (2013.01)

(58) Field of Classification Search
CPC ..... E03B 9/14; E03B 9/16; E03B 9/02; Y10T 137/5456; Y10T 137/5532
See application file for complete search history.

(56) References Cited

U.S. PATENT DOCUMENTS

| | | | |
|---|---|---|---|
| 1,091,210 | A | 3/1914 | Gauntt |
| 2,019,515 | A | 11/1935 | Waterous et al. |
| 3,076,474 | A | 2/1963 | Skomp |
| 3,104,554 | A | 9/1963 | Mueller et al. |
| 3,586,019 | A | 6/1971 | Thomas |
| 3,599,662 | A | 8/1971 | Dashner |
| 3,980,097 | A | 9/1976 | Ellis |
| 4,073,307 | A | 2/1978 | Royce |
| 6,561,214 | B2 | 5/2003 | Heil |

OTHER PUBLICATIONS

"Guardian K81-D Maintenance Manual FHMM-03", Kennedy Valve Company, USA.

*Primary Examiner* — Craig Schneider
*Assistant Examiner* — Kevin Barss
(74) *Attorney, Agent, or Firm* — Brown & Michaels, PC

(57) ABSTRACT

A hydrant main valve includes a main seal elastically deformable between a first state and a second state, such that a main valve assembly may be inserted into a main valve elbow without removable valve seats. A main valve assembly rotation lock engages a rotation block inside the elbow preventing rotation of the main valve assembly. A rotating operating stem extension moves a main valve bottom plate relative to a drain valve body, causing main valve seal elastic deformation.

13 Claims, 18 Drawing Sheets

FIG. 10
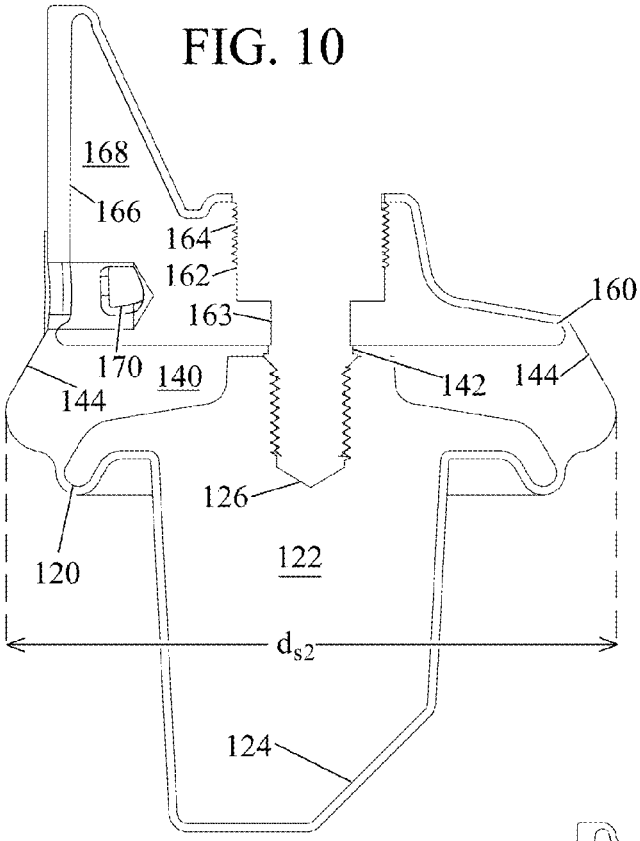
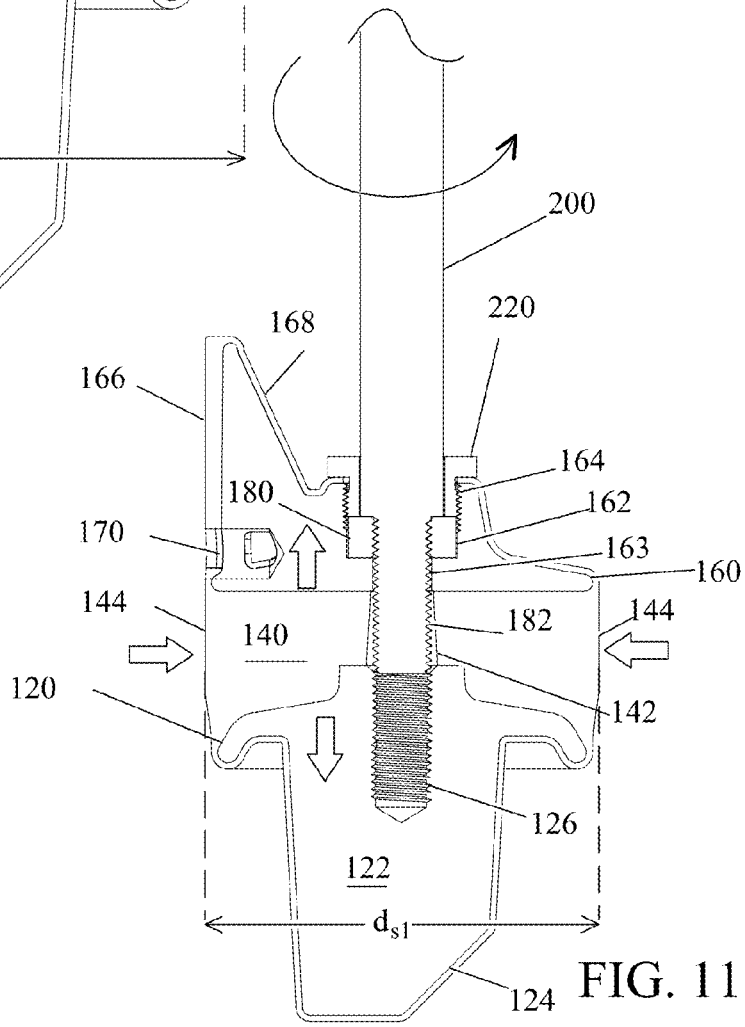
FIG. 11

MAIN VALVE FOR DRY BARREL FIRE HYDRANT

BACKGROUND OF THE INVENTION

1. Field of the Invention

The invention pertains to the field of fire hydrants. More particularly, the invention pertains to dry barrel fire hydrant main valves.

2. Description of Related Art

Fire hydrants were first invented in the early 1800's and followed the wide spread adoption of municipal water lines. By 1858, the cast iron dry-barrel hydrant was developed and became a ubiquitous curb-side fixture in urban areas throughout the US and much of the rest of the world, providing high pressure water at high volumes on nearly every city street.

The dry-barrel hydrant is particularly well suited to colder climates where low temperatures may freeze water in a hydrant and block the flow of water to the hydrant's outlets. Referring to the prior art FIG. 1, the dry-barrel hydrant is constructed in three major assemblies. An upper barrel 10, generally made of cast iron, is located above ground level and provided with outlet ports 40 for attachment of fire hoses. A barrel cap 50 at the top of the upper barrel 10 houses an operating stem nut 60 which may be turned to open or close the flow of water into the hydrant. This configuration defined the "fire plug" design which has since become almost universally recognizable.

The upper barrel 10 is connected to one end of a lower barrel 20 via a mating flange 70, 71, generally of a breakaway design such that the upper barrel 10 can separate from the lower barrel 20 cleanly at the mating flange 70, 71, for example, if struck by an automobile. The lower barrel 20 provides a conduit through which water may flow from a location below the frost line, to the upper barrel 10 where it is needed for subsequent use in firefighting. The other end of the lower barrel 20 is similarly connected via a mating flange 80, 81 to an elbow 32 containing the hydrant's main valve assembly 31. The elbow 32 and main valve assembly 31 are shown in greater detail in prior art FIG. 2. The elbow 32 is also connected to a water main via an intervening gate valve (not shown) that can isolate the hydrant from the water main during installation, repair, or replacement of the hydrant. In this embodiment, a flange 34 is provided on one side of the elbow 32 for this purpose.

The operating stem nut 60 in the barrel cap 50 is threaded to one end of an operating stem 12 (including a breaking coupling 24, and operating stem extension 22) that traverses inside the upper barrel 10, the lower barrel 20, and is connected to the main valve assembly 31 inside the elbow 32 at its opposite end. Turning the operating stem nut 60, in turn, raises and lowers the operating stem 12 (and breaking coupling 24, and operating stem extension 22) and thus the main valve assembly 31 against, or away from, as shown for example in prior art FIG. 2, a main valve seat 33 located in the elbow 32 below a mating flange 80, 81 coupling the lower barrel 20 to the elbow 32. Thus, the elbow 32 has a "wet" side, below the main valve seal 36 inside the elbow 32, and a "dry" side above the main valve seal 36 and main valve seat 33.

The main advantage of this type of valve is that all main valve parts that are in contact with water, separating the "wet" and "dry" sides of the main valve seal 36, are located below the frost line, and therefore protected from freezing, and seizing, in cold temperatures, thus ensuring a reliable supply of water regardless of climate conditions.

As shown in prior art FIG. 2, and in more detail in prior art FIG. 3, drain holes 37 located in the elbow 32 and a valve seat insert 31 inset in the elbow 32, above the level of the main valve seal 36, allow the upper barrel 10 and lower barrel 20 to drain water to surrounding gravel beds or concrete basins once the hydrant main valve seal 36 has been closed against the main valve seat 33 after use. Hence, the term "dry barrel" hydrant is applied, as no water is present in the hydrant upper 10 and lower 20 barrels when the main valve seal 36 in the elbow 32 is closed.

As shown in prior art FIGS. 2-3, the main valve seal 36 is disposed between a main valve bottom plate 35 below the main valve seal 36, and a drain valve body 39 above the main valve seal 36. The operating stem extension 22 passes through the drain valve body 39, the main valve seal 36, and is threaded into the main valve bottom plate 35. Once assembled, drain valve pin 22A (prior art FIG. 3) inserted through the drain valve body 39 and the operating stem extension 22 prevents rotation of the operating stem extension 22 relative to the main valve bottom plate 35 during operation.

As shown in prior art FIGS. 2-3, the drain holes 37 are open to the inner volume of water above the main valve seal 36 when the main valve seal 36 is closed against the valve seat 33, and the upper barrel 10 and lower barrel 20 are allowed to drain (see arrows in prior art FIGS. 2-3). The drain valve body 39 is also provided with a drain valve facing 38, and a spring 38A which biases the drain valve facing 38 to move outwardly toward the valve seat 33. When the main valve seal 36 is opened by downward movement of the operating stem extension 22, the drain valve body 39 also moves downwardly such that the drain valve facing 38 is moved over the drain holes 37 in the elbow 32. The drain valve facing 38 is then held against the drain holes 37 through the spring 38A bias and high pressure water flowing past the main valve 36, effectively blocking the flow of water out of the drain holes 37 in the elbow 32.

This configuration has remained relatively unchanged since it was first developed. However, the main development considerations in the dry-barrel design have focused on anti-freezing, hydraulic efficiency, and ease of maintenance.

Hydraulic efficiency of the dry-barrel hydrant is primarily a function of the internal diameter of the upper barrel 10 and lower barrel 20 used, thus determining the maximum rate at which water can be delivered to the outlet ports 40 of the upper barrel 10. However, main valve seal 36 and valve seat 33 designs also affect hydraulic efficiency.

The elbow 32 is generally made of cast iron. The valve seat insert 31, as shown in prior art FIGS. 2-3, is typically made of bronze, or more recently stainless steel, and is permanently fitted to the elbow 32 where its flange 81 attaches to the lower barrel 20 via a mating flange 80. The main valve seat 33, also made of bronze or stainless steel, is then threaded into the valve seat insert 31 after the main valve seal 36 and operating stem assembly 12, 24, 22 have been lowered into the elbow 32, lower barrel 20, and upper barrel 10.

This valve design creates a stricture in the flow path at the point where the elbow 32 and lower barrel join 20, as the main valve seat 33 inner diameter is forced to be less than the inner diameter of the lower barrel 20 due to the thickness of the main valve seat 33 and valve seat insert 31. Typical lower 20 and upper 10 barrel internal diameters, shown in prior art FIG. 1 respectively as $d_l$ and $d_u$, are approximately 7 inches (17.8 cm), while the effective valve seat 37 inner diameter is only about 6 inches (15.2 cm).

Incorporation of removable main valve seats 33 has been required for installation of the drain valve body 39, main valve seal 36, and main valve bottom plate 35 assembly in the elbow 32, as the main valve seal 36 has a greater diameter than the main valve seat 33 inner diameter and must be located below the main valve seat 33 in the elbow 32.

Removable main valve seats 33 have also led to improved main valve seal 36 serviceability. Historically, a faulty main valve seal 36 could require excavation and replacement of the elbow 32 and the valve components contained therein. However, threaded main valve seats 33, and valve seat inserts 31, allow main valve seats 33 to be removed through the upper 10 and lower 20 barrel after removal of the barrel cap 50 by unthreading the main valve seat 33 from above.

Once unthreaded, the main valve seat 33, the main valve seal 36, drain valve body 39, and a main valve bottom plate 35 may be lifted out of the elbow 32 and barrels 10, 20 using the operating stem assembly 12, 24, 22 that connects the main valve bottom plate 35 and the stem operating nut 60 on the barrel cap 50. Once removed, the entire assembly may be further disassembled and individual components repaired or replaced.

While these designs have found widespread use, machining required to correctly mate the valve seat insert 31 to the elbow 32 increases manufacturing costs. Further, the presence of the valve seat insert 31 limits the internal diameter of the main valve seat 33 so that, for a given diameter lower barrel 20 and upper barrel 10, effective hydraulic efficiency is reduced. Also, time required to remove the main valve seat 33 for servicing increases maintenance costs of installed units.

As a result of these factors, space required for removal of the valve seat 33 through the upper 10 and lower 20 barrels requires a trade-off that results in either over dimensioning the internal diameters of the upper 10 and lower 20 barrels to accommodate a larger outer (and inner) diameter of the main valve seat 33 for removal, or, decreasing water flow by using a smaller diameter valve seat 33 to allow it to fit through smaller diameter upper 10 and lower 20 barrels. And in either case, the presence of the valve seat insert 31 always creates an additional flow restriction between the elbow 32 and the lower barrel 20.

SUMMARY OF THE INVENTION

An improved dry barrel hydrant main valve eliminates the need for separate valve seals and valve seat inserts. An elastomeric main valve seal may be compressed, or alternatively stretched, between a main valve bottom plate and drain valve body such that its diameter changes. These elements together form a main valve assembly.

In a first state, the elastomeric main valve seal has a diameter that may pass through the hydrant upper and lower barrels, and an elbow channel, into an elbow connecting the hydrant to a water main. The main valve assembly may be lowered into place by an operating stem coupled to an operating stem extension.

In one embodiment, once inside the elbow, a blade extending downward from the drain valve bottom plate engages a guide in the bottom of the elbow preventing the main valve assembly from rotating. In turn, rotating the operating stem and operating stem extension changes the distance between the main valve bottom plate and drain valve body, bringing the elastomeric main valve seal into a second state with a larger diameter, and also forming a main seal surface.

In some embodiments, a valve seat may be formed in the elbow and channel connecting the elbow with the lower barrel, such that when the main valve assembly is raised, the main valve surface engages the valve seat. Hydraulic efficiency of the main valve may be improved in these embodiments, as the diameter of the channel in the elbow may be matched to the internal diameter of the upper and lower barrels without strictures caused by removable valve seats and valve seat inserts.

BRIEF DESCRIPTION OF THE DRAWINGS

FIG. 10 shows an alternate embodiment of main valve seal that is molded in its operational form at manufacture.

FIG. 11 shows an alternate embodiment of a main valve seal that has been stretched between a main valve bottom plate and drain valve body to reduce its diameter for insertion into an elbow.

DETAILED DESCRIPTION OF THE INVENTION

A hydrant elbow and main valve that do not require a threaded main valve seat, or valve seat insert, provides several benefits. Manufacturing costs related to construction of a separate main valve seat and valve seat insert may be eliminated. Also, their fitment to the elbow may be eliminated, simplifying manufacturing, installation, and reducing overall manufacturing costs. Similarly, servicing of the main valve may be accomplished more rapidly and with fewer components and tools. Also, by eliminating both a valve seat insert, and a separate main valve seat, the effective diameter of the main valve may be increased without increasing other valve dimensions or the upper and lower barrel inner diameters, thus improving hydraulic efficiency of the valve.

Figure 4:
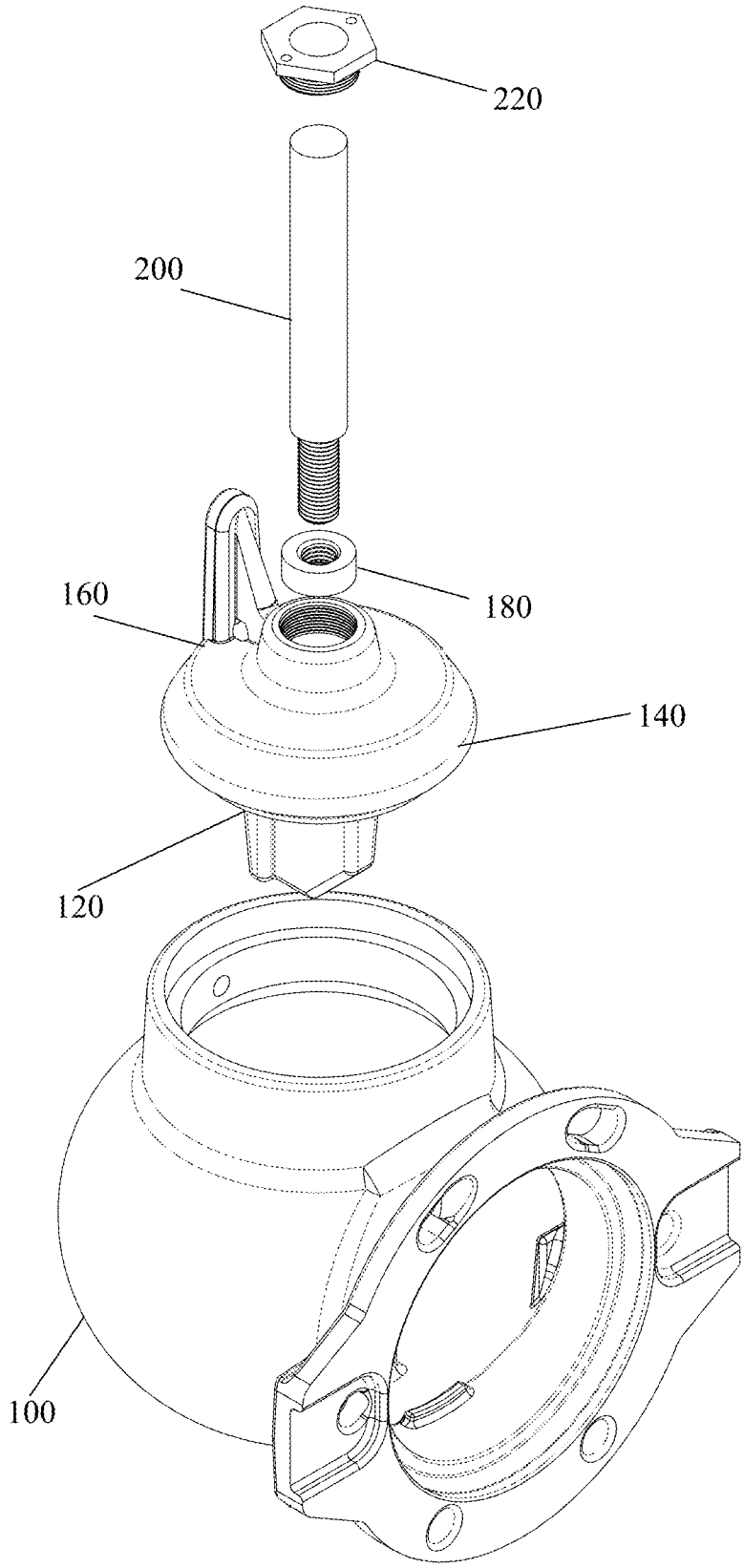
FIG. 4 shows a perspective view of an improved elbow and main valve assembly.

An embodiment of an improved elbow and main valve components is shown in perspective in FIG. 4, including an elbow 100, a main valve bottom plate 120, a main valve seal 140, a drain valve body 160, a thrust bearing 180, an operating stem extension 200, and a retaining nut 220. The assembly and operational relationship of this main valve embodiment and its elements are shown in cross-section in FIGS. 5-9. Identical reference numbers have been used in all figures to indicate identical elements.

The main valve seal 140 may be formed from an elastomeric material that can be compressed, or alternatively stretched in tension, between the a main valve bottom plate 120 and a drain valve body 160 which are coupled to the operating stem extension 200 such that they may move relative to each other when the operating stem extension 200 is rotated. Compression, or alternatively stretching under tension, of the main valve seal 140 changes its diameter so that it may be inserted and removed from the elbow 100 without the need for removable valve seats or valve seat inserts.

Figure 5:
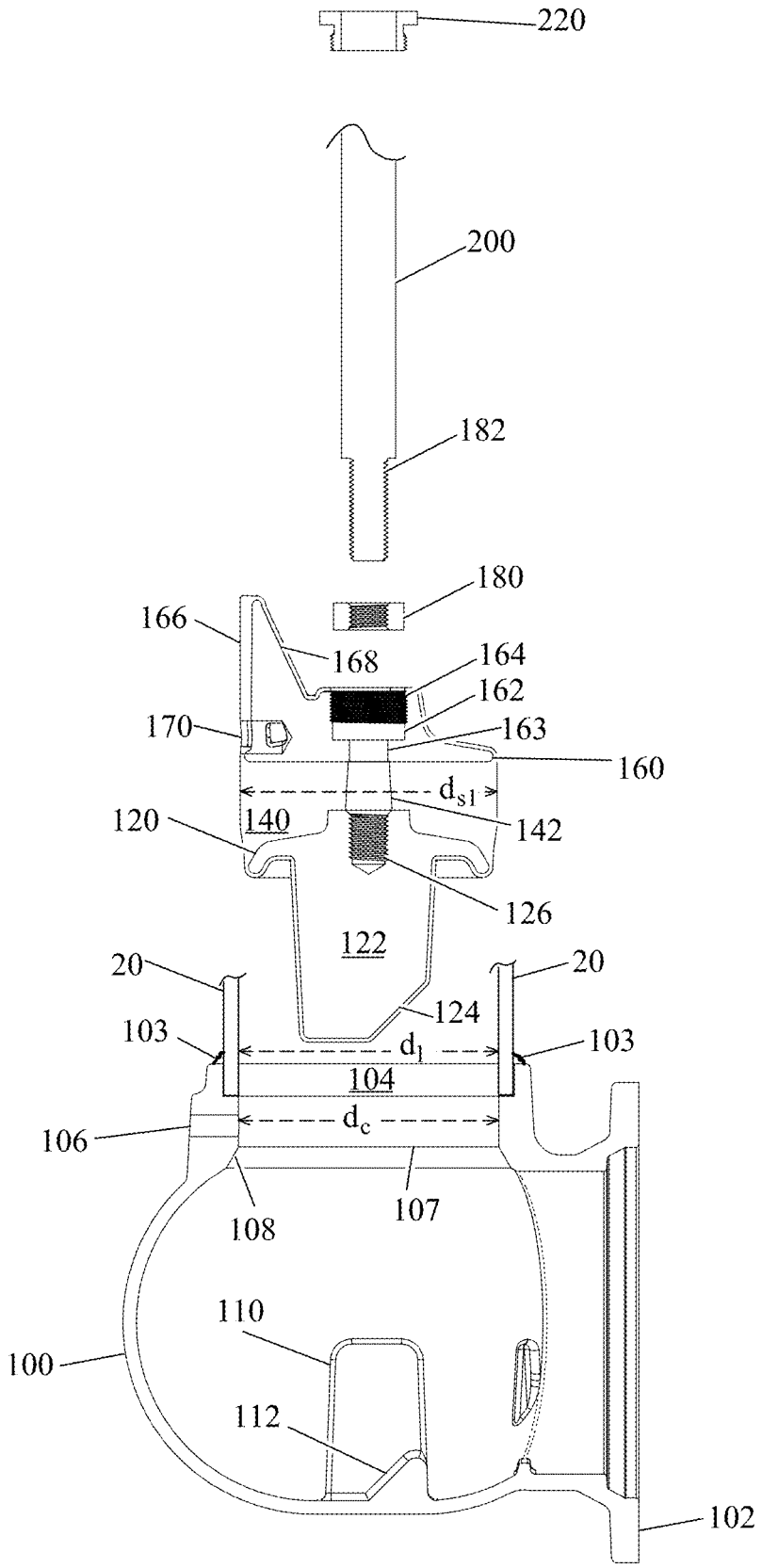
FIG. 5 shows a cross sectional view of an elbow, and components of a main valve assembly.

Referring now to FIG. 5, the elbow 100 may be constructed with a flange 102 for connection to a water main in the conventional manner. While the elbow 100 may also be constructed with a flange for connection to a lower barrel 20, in preferred embodiments a socket 104 is formed at the top of the elbow 100 and elbow channel 107 for receiving a lower barrel 20. The socket 104 may be provided with internal threads 105 (see FIG. 14) that mate with threads on one end of a lower barrel 20, or the socket 104 may be unthreaded such that one end of a lower barrel 20 may be inserted into the socket 104, and then secured by welding 103 about the circumference of the junction thus formed.

A channel 107 at the top of the elbow 100 may be provided for water to flow out of the elbow 100 and into the lower barrel 20. The lower end of the channel 107 may be chamfered about its circumference, forming a main valve seat 108 inside the elbow 100 below the channel 107. The socket 104, channel 107, and valve seat 108 may all be formed as an integral part of the elbow 100 using conventional casting techniques known in the art. If necessary, the socket 104, channel 107, and main valve seat 108 may be worked further, dimensioned, and polished also using techniques known in the art such as CNC multi-axis milling equipment. An elbow drain hole 106 may also be provided in the elbow 100 communicating through the elbow 100 to the channel 107. The elbow drain hole 106 may also be formed during casting and/or with reworking techniques known in the art.

Figure 1:
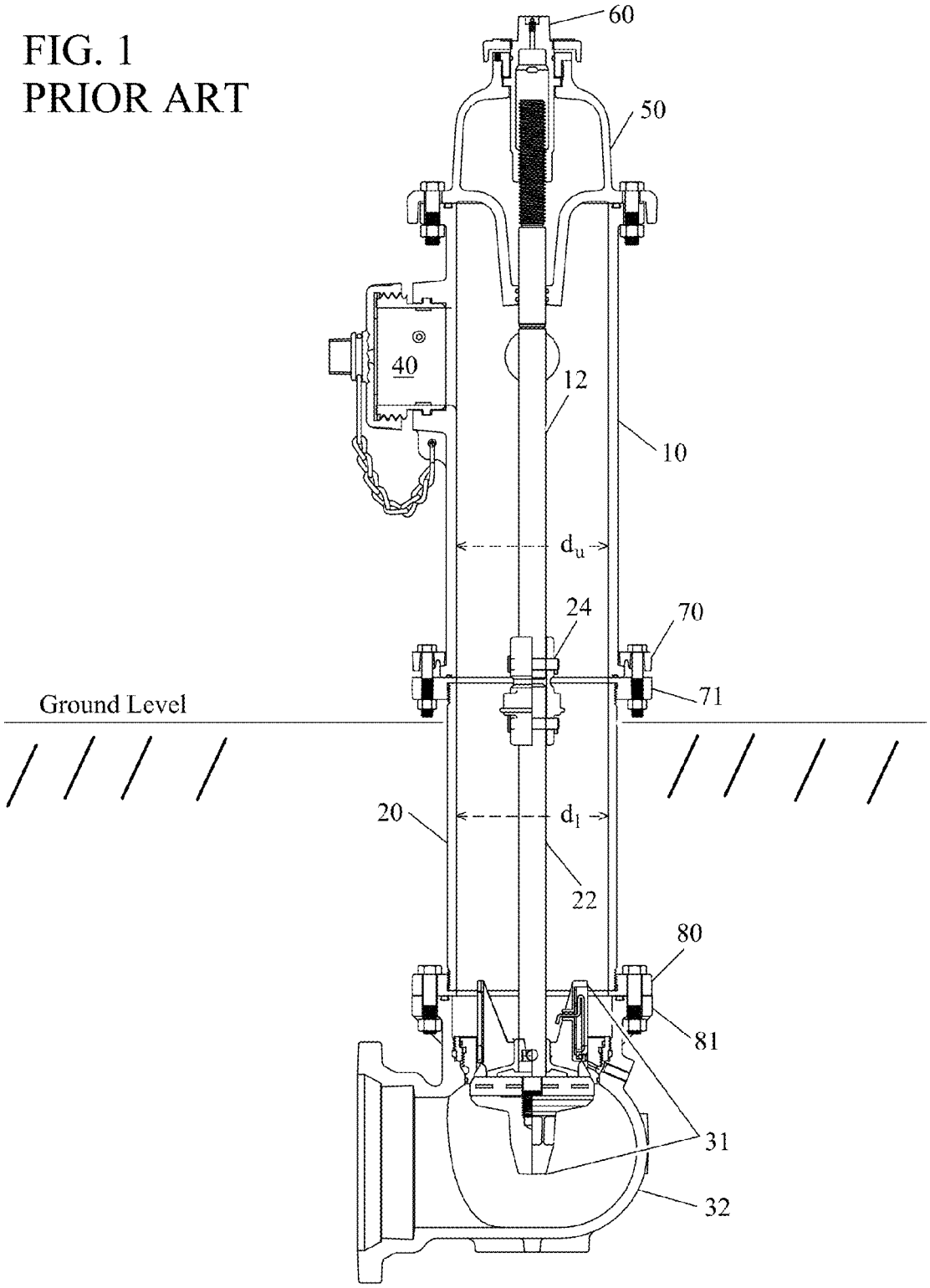
FIG. 1 PRIOR ART
FIG. 1 shows a prior art hydrant with an upper barrel, a lower barrel, elbow, and main valve assembly.
Figure 2:
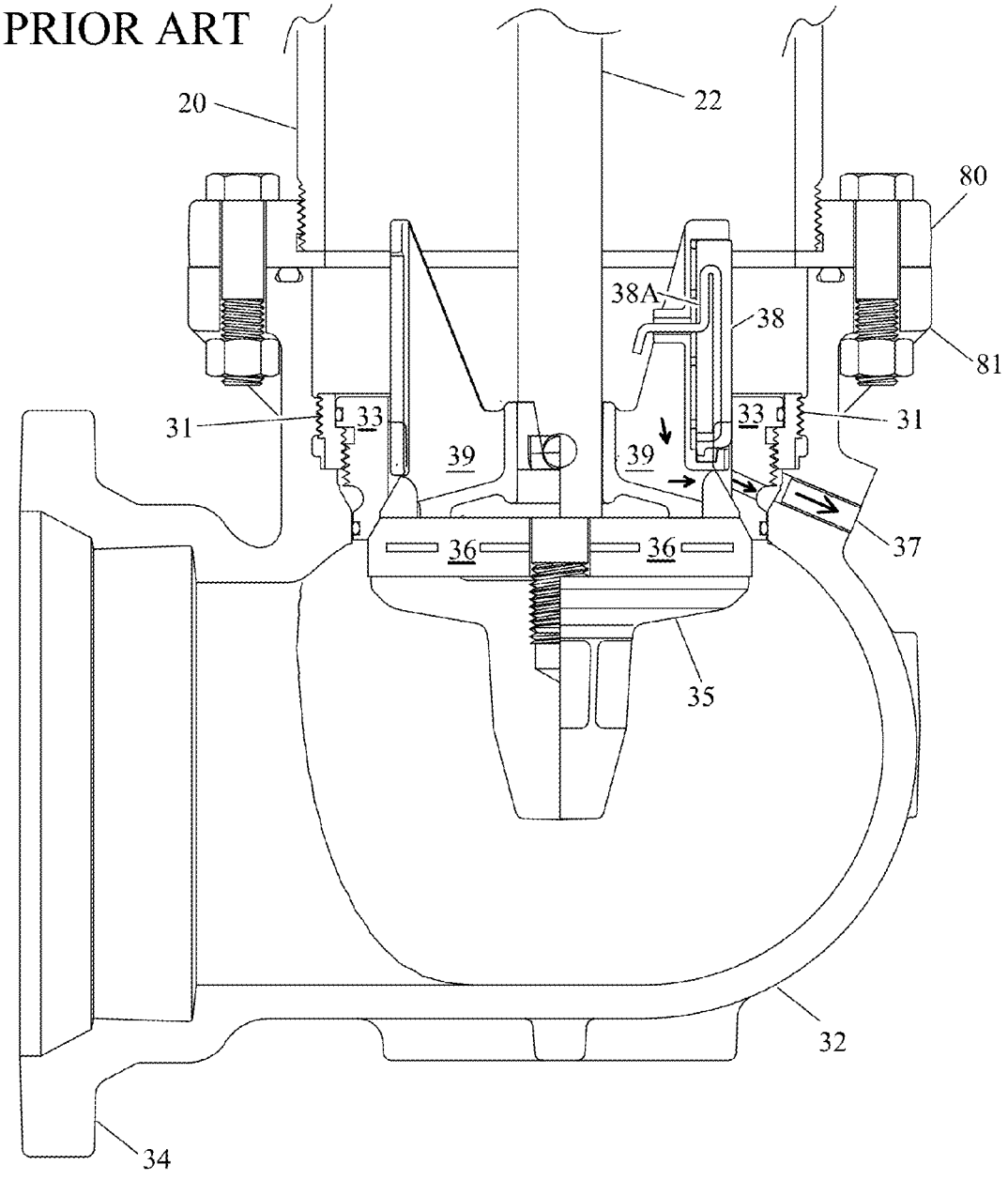
FIG. 2 PRIOR ART
FIG. 2 shows a prior art elbow and main valve assembly.
Figure 3:
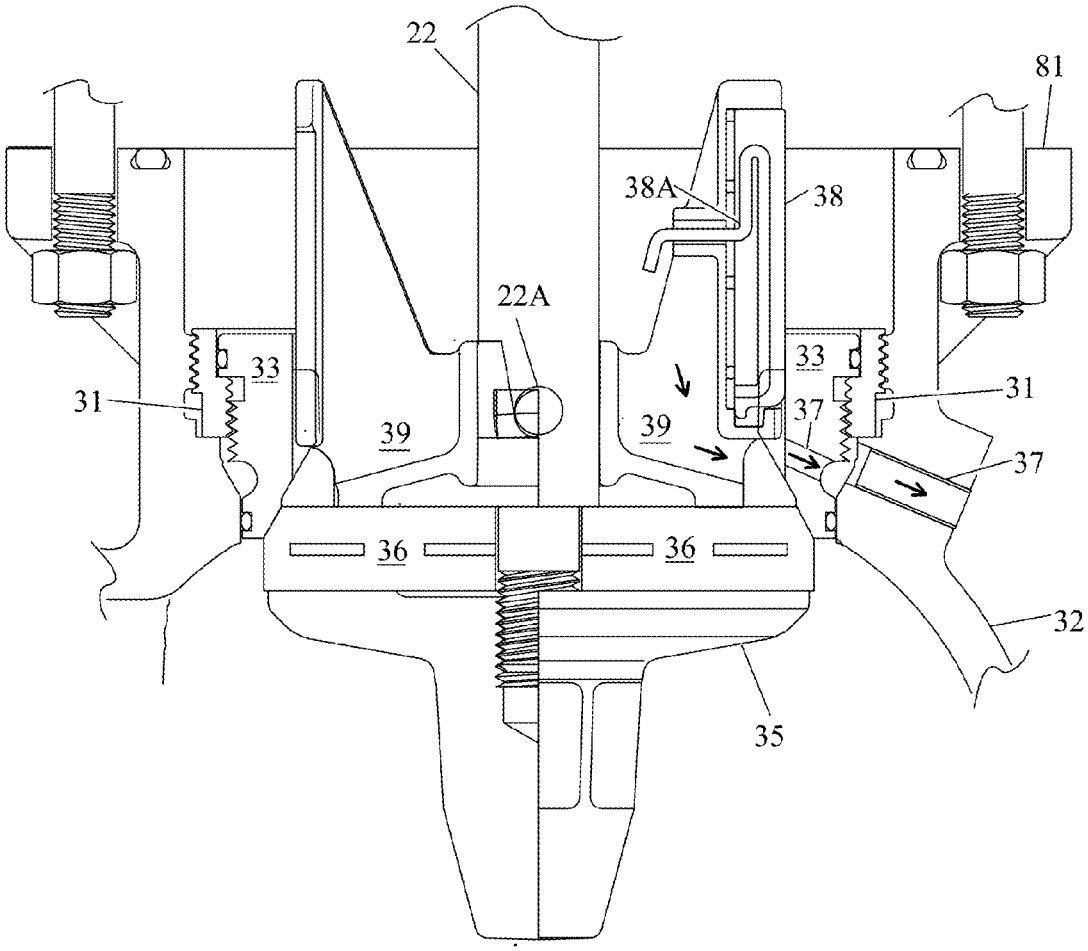
FIG. 3 PRIOR ART
FIG. 3 shows a detailed view of a prior art elbow and main valve assembly.

The construction of the socket 104, channel 107, and main valve seat 108 described herein make one advantage of the improved main valve over the prior art readily apparent. No separate main valve seat inserts or valve seat rings are used. Hence, the diameter, $d_c$, of the channel 107 may be matched to the internal diameter, $d_l$, of the lower barrel 20 (and upper barrel 10 diameter, $d_u$, shown in FIGS. 1 and 14) for improved hydraulic efficiency.

At the bottom of the elbow 100, two parallel plates 110 (only one plate is shown in this cross-section) may extend vertically upward inside the elbow 100. The space between the plates is substantially open and aligned with a plane that coincides with the location of the elbow drain hole 106 in the channel 107. A wedge 112 may also be formed between the parallel plates 110 at their lower extent, and positioned at the side of the plates 100 which is furthest from the drain hole 106. The plates 110 and wedge 112 thus form a guide in the bottom of the elbow 100. This guide may be formed as an integral portion of the elbow 100 casting as a surface of the elbow 100, or may be constructed separately and affixed, for example by welding, to the desired location in the elbow 100 after it has been cast.

The main valve bottom plate 120 may be substantially formed as a disk with a diameter less than $d_c$, and of sufficient thickness to provide for a threaded hole 126 through the main valve bottom plate 120 at its center. A blade 122 may also extend vertically down from the lower surface of the main valve bottom plate 120. The blade 122 has a thickness approximately equal to the spacing between the parallel plates 110 at the bottom of the elbow 100 so that the blade may freely move into and out of the guide formed by the parallel plates 100 and the wedge 112.

The blade geometry and configuration may vary, and is shown in FIG. 5 as a substantially rectangular structure that has had one corner removed, forming a wedge with an angled side 124 at the bottom of the blade 122. Other geometries may be used, provided the blade 122 is capable of mating with the guide formed by the parallel plates 110 and wedge 112 at the bottom of the elbow. The blade 122 acts as a rotation lock and the parallel plates 110 acts as a rotation block. Hence, when the blade 122 is engaged between the parallel plates 110, rotation of the main valve bottom plate 120 relative to the elbow 100 is prevented.

The drain valve body 160 may also be substantially formed as a disk with a diameter less than $d_c$. An aperture through the center of the drain valve body 160 may have a threaded portion 164 at the top of the aperture, an unthreaded portion 162 in the middle of the aperture, and a smaller diameter unthreaded portion 163 at the bottom of the aperture. The drain valve body 160 may further include a drain valve slide 168 extending vertically upward from the upper surface of the drain valve body 160, and substantially along a radius of the disk shaped drain valve body 160.

In one preferred embodiment, shown in FIG. 5, the main valve seal 140 may be molded in a first state with a cross-section and an outer diameter, $d_{s1}$, as a substantially annular cylinder with a central passage 142. The main valve seal 140 outer diameter, $d_{s1}$, may be slightly smaller than the diameter, $d_l$, of the lower barrel 20 and the diameter, $d_c$, of the channel 107 (and the diameter, $d_u$, of the upper barrel 10, shown in FIGS. 1 and 14). Thus, when assembled, the drain valve body 160, main valve seal 140, and main valve bottom plate 120 may pass through the upper barrel 10, lower barrel 20, and the channel 107.

During manufacture, a bonding agent (such as an adhesive) is preferably applied to the outer surfaces of the drain valve body 160 and main valve bottom plate 120. The drain valve body 160 and main valve bottom plate 120 may then be placed in a mold and held in an orientation such that the plane of the main valve bottom plate 120 blade 122 is held in the same plane as the drain valve port 170 of the drain valve body 160.

In one preferred embodiment, the mold is constructed such that a small space remains open between the inside surface of the mold and the external surfaces of the drain valve body 160 and main valve bottom plate 120. The mold also maintains a separation between the top of the main valve bottom plate 120 and the bottom of the drain valve body 160 a distance that will determine the thickness of the main valve seal 140 after molding. Mold inserts known in the art may be used to plug elements to be protected during the molding process, such as the drain valve port 170, the aperture 162, 163, 164 through the drain valve body 160, and the threaded hole 126 in the top of the main valve bottom plate 120.

The mold may then be filled with an elastomer that will form the main valve seal 140, and also coat the outer surfaces of the drain valve body 160 and main valve bottom plate 120. In one preferred embodiment, the mold may be filled with ethylene propylene diene monomer rubber (EPDM), however other elastomer materials such as styrene-butadiene (SBR), nitrile rubber, or neoprene rubber, for example, may also be used. The contents of the mold may then be cured, forming the main valve seal 140 and a continuous elastomer coating 121 (see FIG. 6) around the drain valve body 160 and main valve bottom plate 120, as well as a drain valve facing 166. In other embodiments, the mold may be matched to the shape of the drain valve body 160 and main valve bottom plate 120 such that only a main valve seal 140 and drain valve facing 166 are bonded to the drain valve body 160 and main valve bottom plate 120.

Prior application of a bonding agent to the drain valve body 160 and main valve bottom plate 120 and curing creates a rubber tearing bond between the drain valve body 160 and the main valve seal 140, the main valve seal 140 and the main valve bottom plate 120, and the elastomer coating 121 the drain valve body 160 and main valve bottom plate 120 on their outer surfaces.

A "rubber tearing bond" is defined as an engineering bond, generally between metal and rubber (an elastomer), that will cause a failure in the rubber (elastomer) when exposed to destructive testing before a failure in the bond between the metal and rubber (elastomer) will occur. Coating 121 of the drain valve body 160, and particularly the drain valve slide 168, may also create a drain valve facing 166 that similarly includes an elastomer layer bonded to the drain valve slide 168 with a rubber tearing bond.

Figure 6:
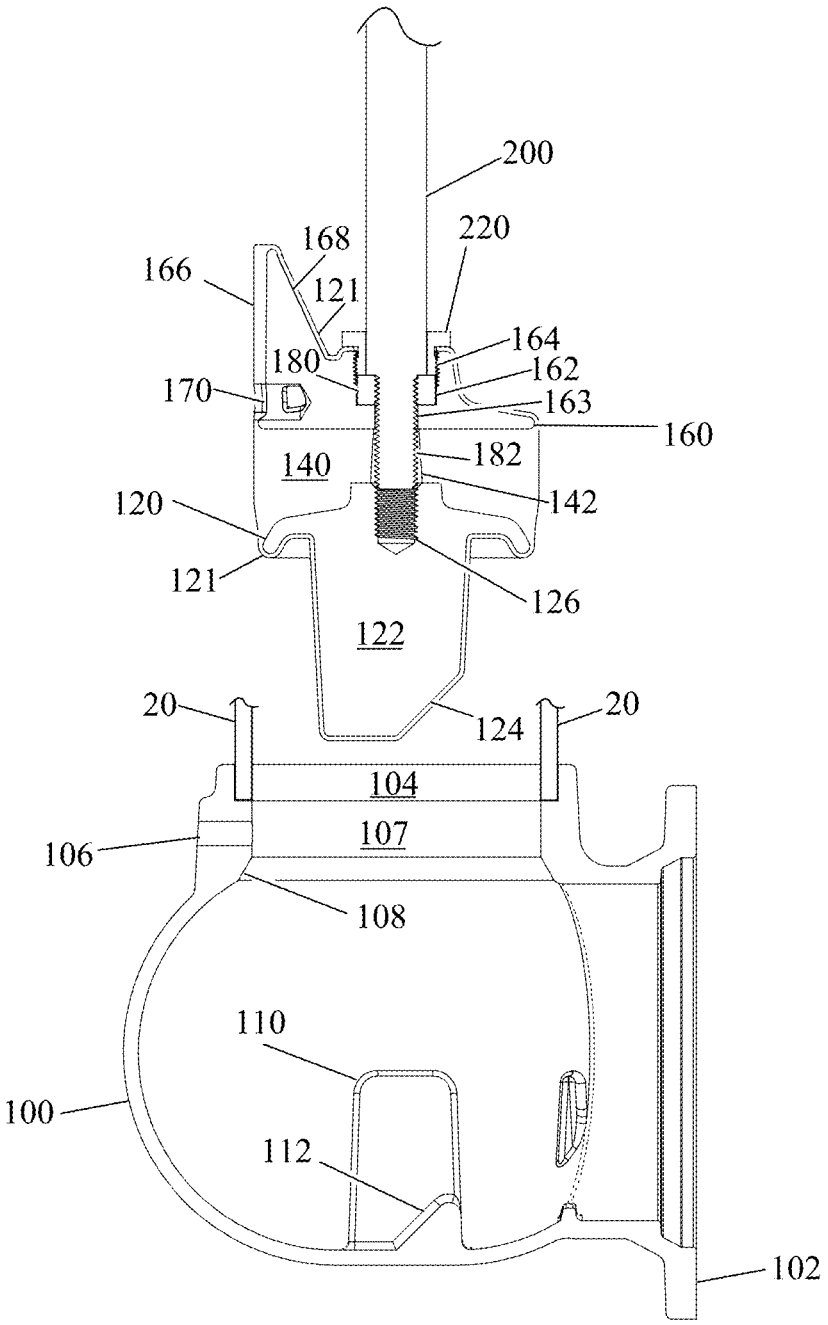
FIG. 6 shows a main valve bottom plate, main valve seal, drain valve body, and operating stem extension assembled prior to installation in an elbow.

Referring now to FIG. 6, prior to insertion into the elbow 100, the thrust bearing 180 may be threaded onto one end 182 of the operating stem extension 200 such that an unthreaded portion of the operating stem extension 200 is above the thrust bearing 180, and the remaining threaded end 182 of the operating stem extension 200 protrudes below the thrust bearing 180. The threaded end 182 of the operating stem extension 200, may then be inserted through the aperture sections 162, 163, 164 in the drain valve body 160.

The threaded end of the operating stem extension 200 passes through the central passage 142 in the main valve seal 140, and is threaded into the hole 126 in main valve bottom plate 120 until the thrust bearing 180 is received within aperture section 162 in the drain valve body 160, and blocked by the smaller diameter aperture section 163. A retaining nut 220 slid over the operating stem extension 200 and threaded into the aperture section 164 holds the drain valve body 160 in a fixed longitudinal position on the operating stem extension 200 while allowing the operating stem extension 200 to rotate until the retaining nut 220 is fully tightened.

Thus, the thrust bearing 180 residing in the aperture section 162 couples the drain valve body 160 to the operating stem extension 200 such that the operating stem extension 200 may rotate relative to the drain valve body 160, and the position of the drain valve body 160 longitudinally on the operating stem extension 200 is fixed since the thrust bearing 180 is prevented from moving through the drain valve body 160 by the smaller lower aperture section 163 on the one side and the retaining nut 220 on the other side. Similarly, the operating stem extension 200 is coupled to the main valve bottom plate 120 by the threaded end 182 of the operating stem extension 200 mating with the threaded hole 126 of the main valve bottom plate. This coupling allows the main valve bottom plate 120 to move longitudinally along the operating stem extension 200 when the operating stem extension 200 is rotated.

Figure 7:
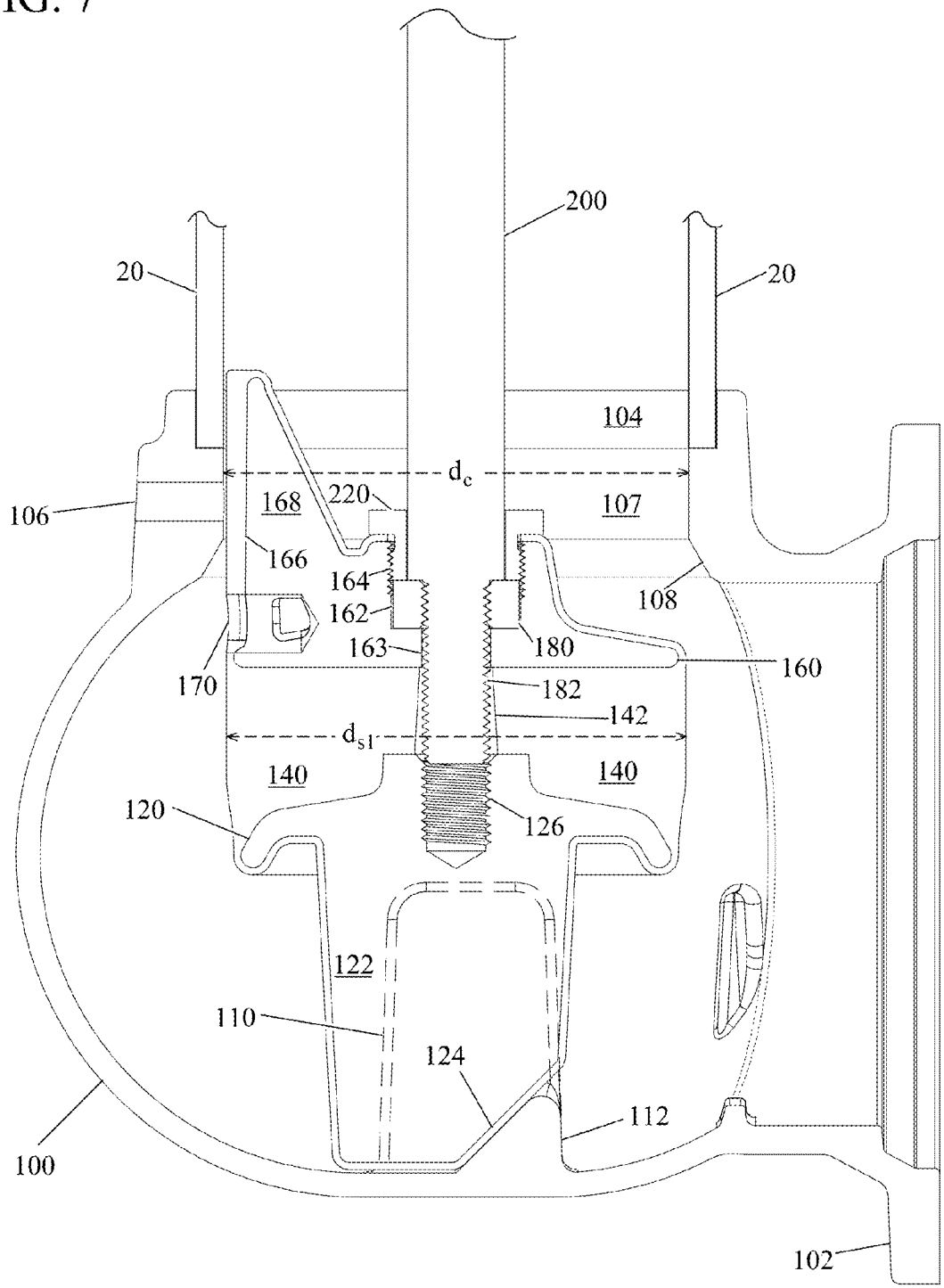
FIG. 7 shows a main valve bottom plate, main valve seal, drain valve body, and operating stem extension after being inserted in an elbow.

Referring now to FIG. 7, as the assembled drain valve body 160, main valve seal 140, and main valve bottom plate 120 have a diameter, $d_{s1}$, that is slightly less than the diameter, $d_c$, of the elbow 100 channel 107, the entire assembly may be inserted into the elbow 100 from above through the upper barrel 10 (not shown in this figure), lower barrel 20, and channel 107. When properly inserted, the main valve bottom plate 120 blade 122 rests within the guide formed by the two parallel plates 110 (dashed lines in FIG. 7) at the bottom of the elbow 100. The plates 110, acting as a rotation block, thus prevent the blade 122, acting as a rotation lock, and main valve bottom plate 120 from rotating when the operating stem extension 200 is turned (via the operating stem 12 and breaking coupling 24 shown in FIG. 14).

Figure 8:
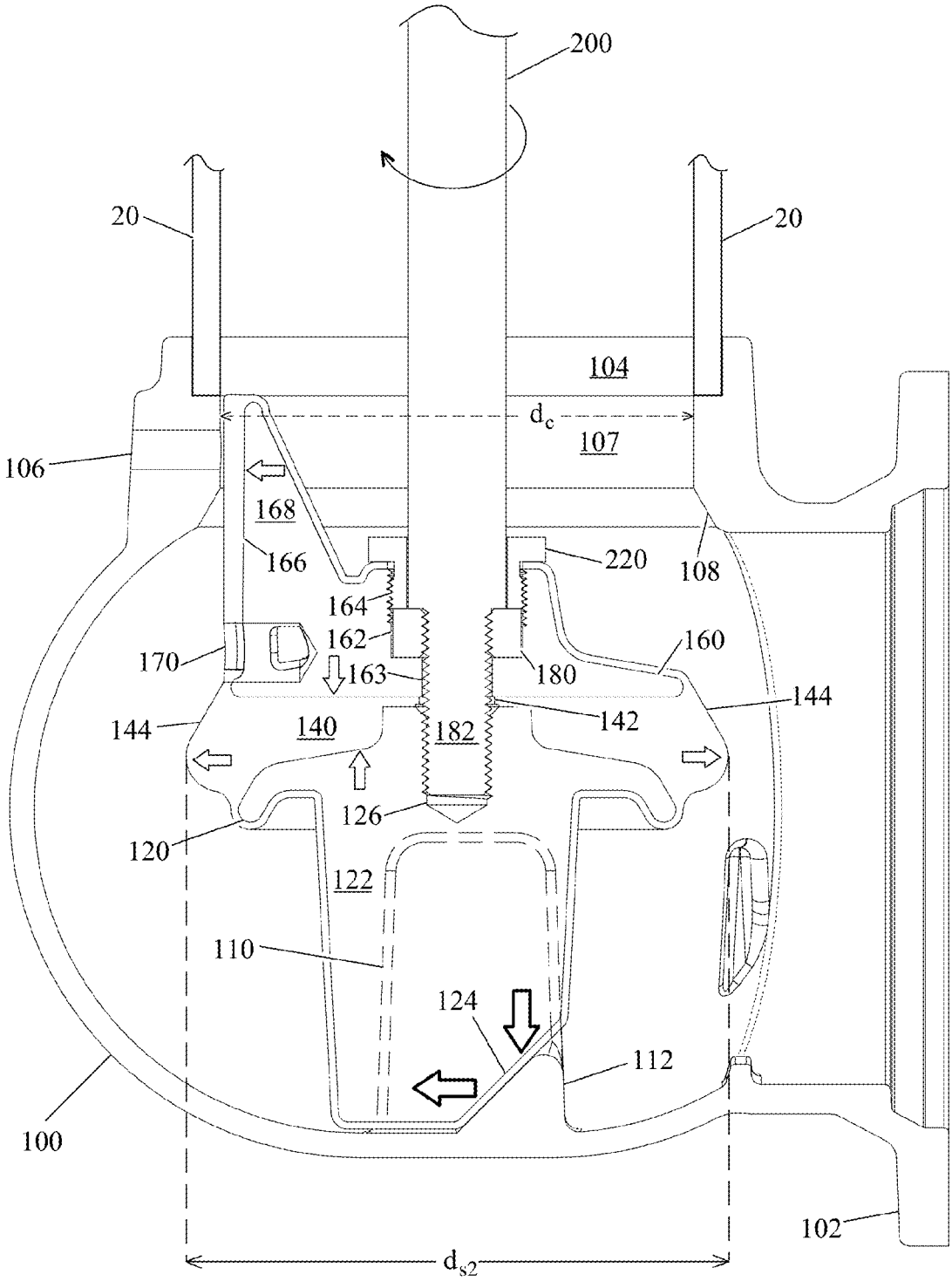
FIG. 8 shows a main valve bottom plate and drain valve body compressing a main valve seal by rotation of an operating stem extension after insertion in an elbow.

FIG. 8 illustrates the compression of the main valve seal 140 into a second state with a second cross-sectional profile and a second diameter, $d_{s2}$, that is larger than the channel 107 diameter, $d_c$. The plates 110 and blade 122 (a rotation block and a rotation lock, respectively) prevent the main valve bottom plate 120 from rotating, which in turn prevents the main valve seal 140 and drain valve body 160 from rotating as their bonding to each other and the main valve bottom plate 120 rotationally couples the three elements. The operating stem extension 200 may then be rotated to move the threaded end 182 of the operating stem extension 200 further into the hole 126 in the main valve bottom plate 120.

The thrust bearing 180 in turn forces the drain valve body 160 and the main valve bottom plate 120 to move closer to each other on the operating stem extension 200. In the process, the elastomeric main valve seal 140 elastically deforms and may be forced outwardly from the space between the two. The material thus forced out from between the main valve bottom plate 120 and drain valve body 160 at their perimeter forms a main valve seal 140 with a diameter, $d_{s2}$, that is larger than the channel 107 diameter, $d_c$, and provides a mating surface 144 for the valve seat 108 when the main valve is closed.

For the purposes of this description, "elastic deformation" is understood to be a reversible change in the dimensions of a material, in which the material has a first set of dimensions when no forces are applied to it, the material transitions to a second set of dimensions when forces are applied to it, and transitions back to its original set of dimensions when the forces are no longer applied. Such deformation includes but is not limited to changes in spatial dimensions and combinations thereof (e.g., changes in volume, cross-sectional profile, and diameter), and may result from forces including, but not limited to, forces of compression and/or stretching under tension.

Having compressed the main valve seal 140 into its second state operational diameter, $d_{s2}$, and second state profile, the retaining nut 220 may be tightened from above, using for example an "L" shaped wrench with an extended handle, locking the thrust bearing 180 and operating stem extension 200 into the drain valve body 160 such that the operating stem 200 may not rotate and loosen the connection between the main valve bottom plate 120 and drain valve body 160 during normal operation of the main valve.

Figure 14:
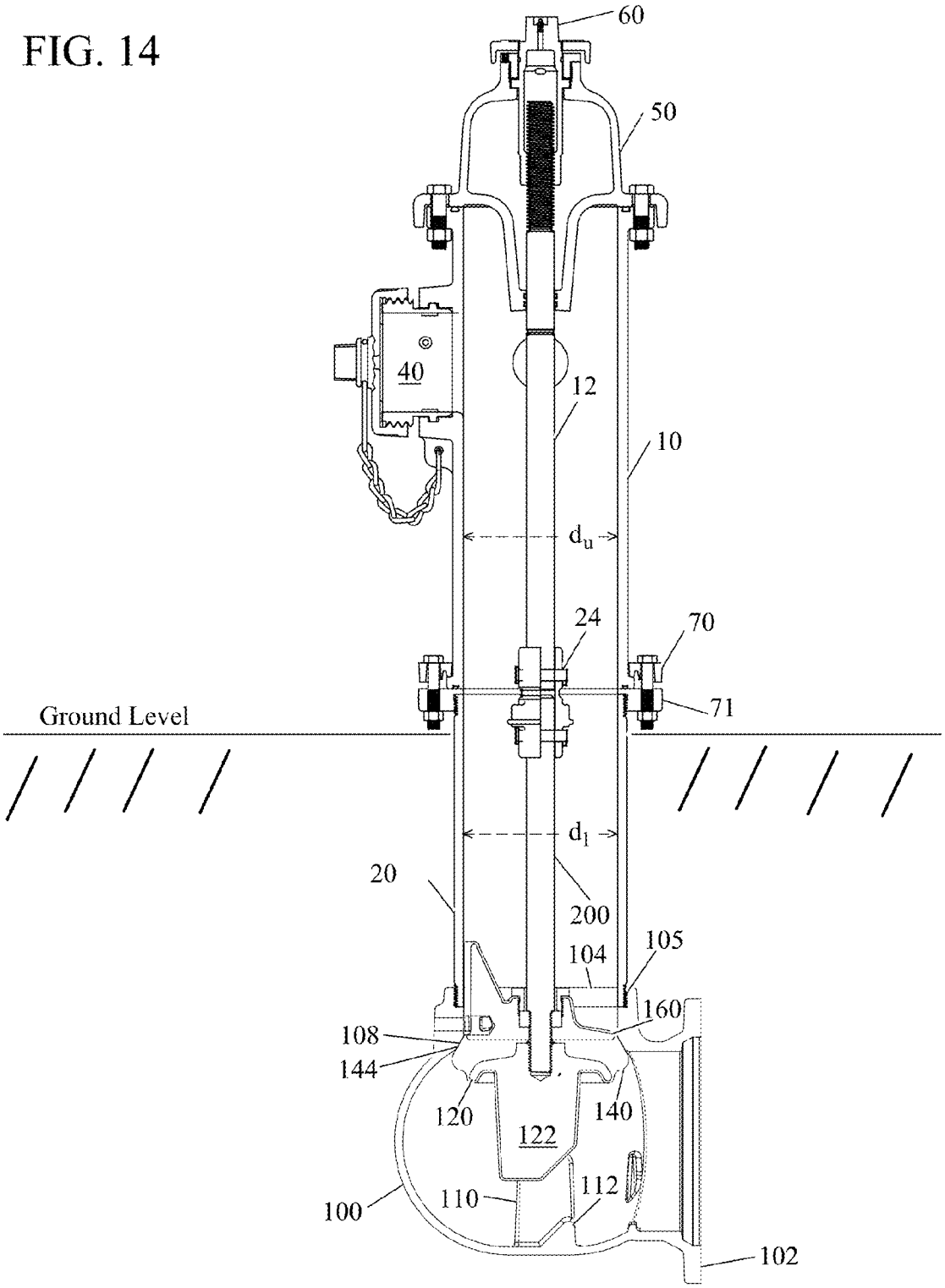
FIG. 14 shows a complete hydrant assembly with an upper barrel, a lower barrel, improved elbow, and an improved main valve assembly.
Figure 15:
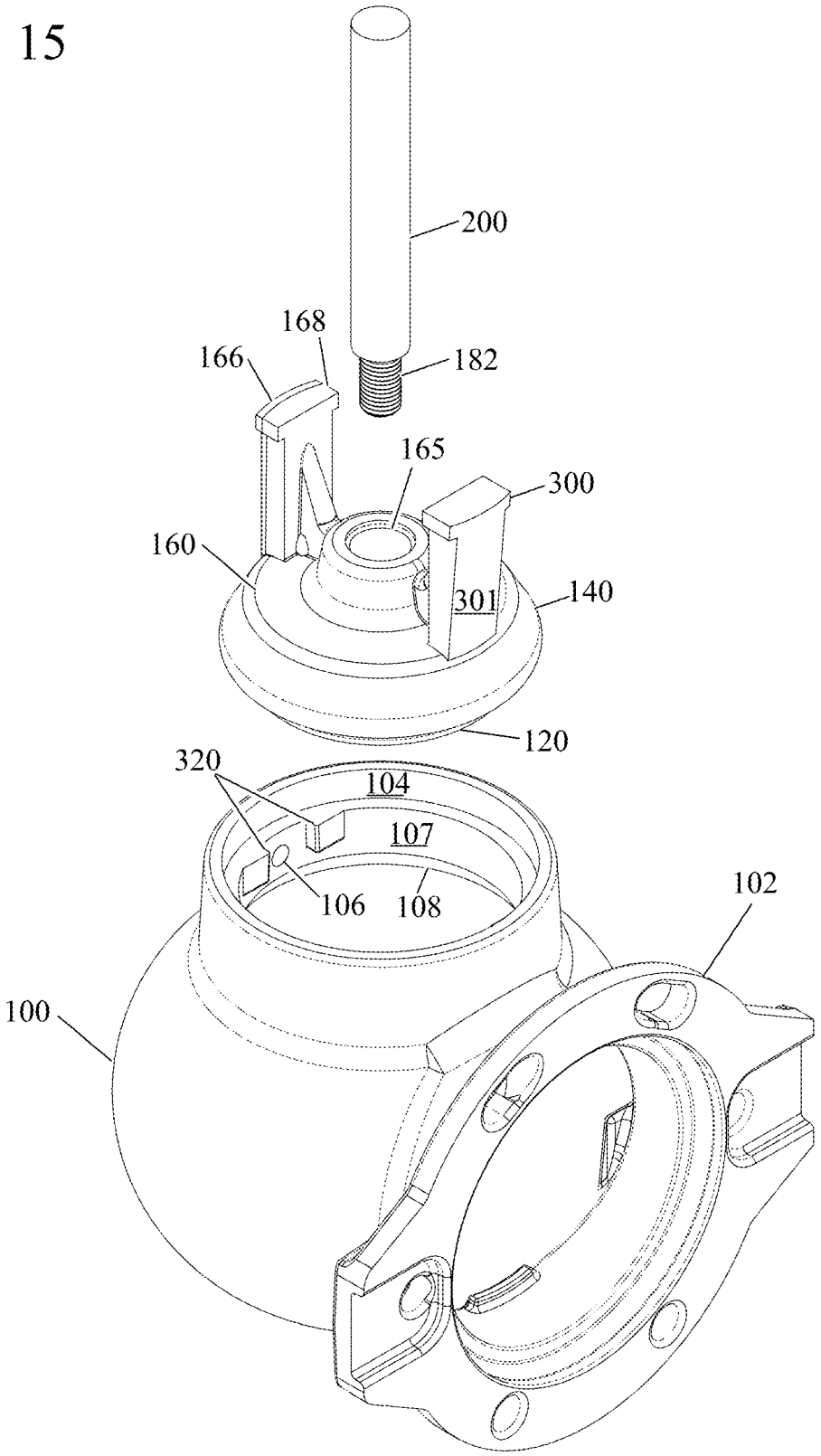
FIG. 15 shows a perspective view of an alternate embodiment of a main valve assembly and an elbow having slots for receiving slides on a drain valve body.

As shown in FIG. 14, the barrel cap 50 and operating stem nut 60, may now be assembled to the upper barrel 10 and operating stem extension 200 (including the operating stem 12 and breaking coupling 24), in the usual manner to bring the hydrant into complete operational status.

FIG. 8 also illustrates the operation of the elbow drain hole 106 and drain valve body 160. When the main valve is fully opened, as represented in this figure, the bottom plate 120 blade 122 angled side 124, acting as a first wedge element, meets the opposing second wedge 112 between the two parallel plates 110 at the bottom of the elbow 100 and forming an interior surface of the elbow 100. Downward force imparted by the operating stem extension 200 through the main valve bottom plate 120 onto the blade 122 and blade angled side 124 (a first wedge) is deflected laterally by the second wedge 112 as the two wedge elements move relative to each other. This lateral force biases the entire main valve assembly (main valve bottom plate 120, main valve seal 140 and drain valve body 160) toward the elbow drain hole 106. Thus, the drain valve slide 168 and drain valve facing 166 are brought into positive contact with, and completely cover, the elbow drain hole 106, blocking high pressure water from exiting the elbow 100 when the main valve is opened.

Figure 9:
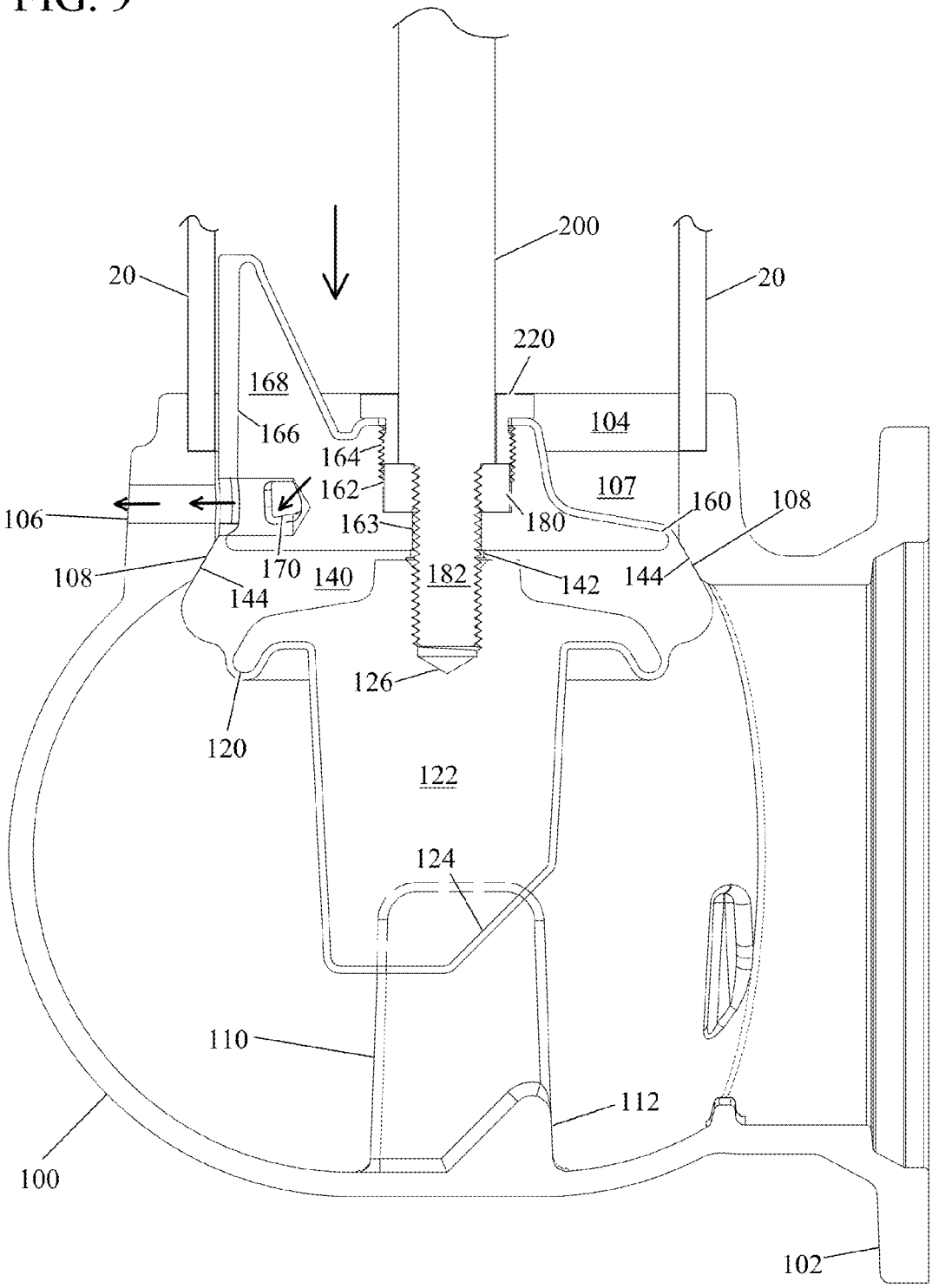
FIG. 9 shows a main valve bottom plate, main valve seal, and drain valve body positioned against a valve seat in an elbow closing the main valve.

Referring now to FIG. 9 and FIG. 14, the main valve may be closed by turning the operating stem nut 60, to raise main valve assembly (main valve bottom plate 120, main valve seal 140, and drain valve body 160) within the elbow 100 such that the now expanded main valve seal surface 144 comes into mating contact with the valve seat 108 at the lower extent of the elbow 100 channel 107. Positive mating contact, and a tight seal, is provided by the upward lifting force of the operating stem 12 and operating stem extension 200 as the operating nut 60 is turned, as well as through the force of high pressure water in the elbow 100 below the main valve bottom plate 120 forcing the main valve seal 140 and its seal surface 144 upwardly against the valve seat 108.

The blade 122 extending downward from the main vale bottom plate 120 remains between the parallel plates 110 at the bottom of the elbow 100 at all times and prevents rotation of the main valve assembly (main valve bottom plate 120, main valve seal 140 and drain valve body 160) at all times as they are rotationally coupled as described herein. The bonding between the main valve bottom plate 120, main valve seal 140, and drain valve body 160, combined with the rotational restraint placed on the main valve assembly by the blade 122 and parallel plates 110 acting as a rotation lock and a rotation block, respectively, ensures that the location of the drain slide 168, drain valve facing 166, and drain port 170 remain in functional orientation with the drain hole 106 in the elbow 100 at all times.

Thus, when the main valve assembly is raised to close the main valve, as shown in FIG. 9 and FIG. 14, the drain port 170 may be brought into alignment with the elbow drain hole 106. As high pressure water from the water main is now blocked from entering the lower barrel 20 by the main valve seal 140 and valve seat 108, any water remaining in the lower barrel 20 and upper barrel 10 is now free to flow (see arrows) unimpeded through the drain port 170 (and drain valve facing 166) and elbow drain hole 106 and enter gravel beds, concrete traps, or other drainage facilities.

Construction and installation of the main valve assembly has been described starting with a generally annular cylinder forming the main valve seal 140 first state, and using compression and elastic deformation to squeeze the main valve seal 140 outwardly from the perimeters of the main valve bottom plate 120 and drain valve body 160 into a second state.

In an alternate embodiment, as shown in FIGS. 10-11, the main valve seal 140 may be molded in a second state with a cross section that produces a main valve seal surface 144 in its operational shape and diameter, $d_{s2}$. In this embodiment, the manufacturing methods and structural elements produced thereby and described herein are substantially unchanged, and produce a main valve seal 140 that is bonded to the lower surface of the drain valve body 160 and the upper surface of the main valve bottom plate 120. The native shape (second state) of the main valve seal surface 144 after bonding and curing, as shown in FIG. 10, is however the same as it is in operation, such that after installation in the elbow, the main valve seal is neither in compression or tension, other than its compressive mating to the valve seat 108 in the elbow 100.

After assembly with the operating stem extension 200, the thrust bearing 180, and retaining nut 220, the operating stem extension 200 may be fully threaded into the hole 126 in the main valve bottom plate 120. Hence, as shown in FIG. 11, when the operating stem extension 200 is unthreaded and backed out of the main valve bottom plate 120, the thrust bearing 180 applies force to the retaining nut 220, causing the drain valve body 160 and main valve bottom plate 120 to move away from each.

This relative motion of the drain valve body 160 and main valve bottom plate 120 stretches the main valve seal 140 bonded to them, causing the main valve seal 140 to elastically deform to a first state in which the diameter, $d_{s1}$, and cross-sectional profile of the main valve seal 140 (see arrows) retracts to less than the channel 170 diameter, $d_c$ (shown in FIGS. 7-8), so that the main valve seal 140 may pass unobstructed through the channel 170 (and upper barrel 10 and lower barrel 20) for installation. After being inserted into the elbow 100, the operating stem extension 200 may be turned in the opposite direction to bring the drain valve body 160 and main valve bottom plate 120 back to their original separation, and allow the main valve seal 140 to return to its molded second state with a diameter, $d_{s2}$, such that it forms a seal surface 144 and a mating seal with the valve seat 108 inside the elbow.

Figure 12:
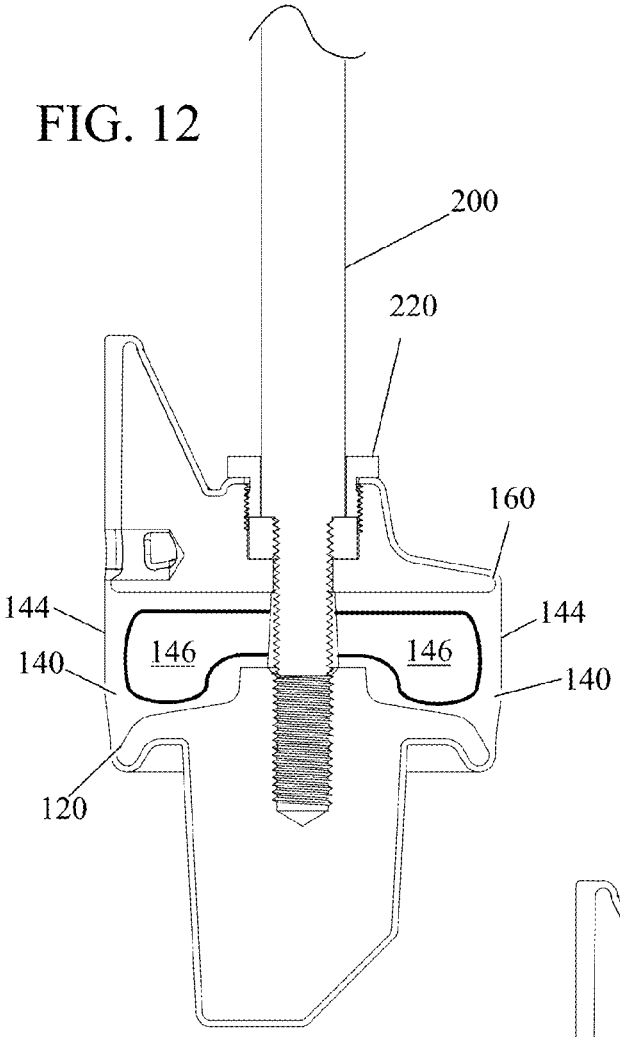
FIG. 12 shows an alternate embodiment of a main valve seal that has a core molded into it, prior to compression between a main valve bottom plate and drain valve body.
Figure 13:
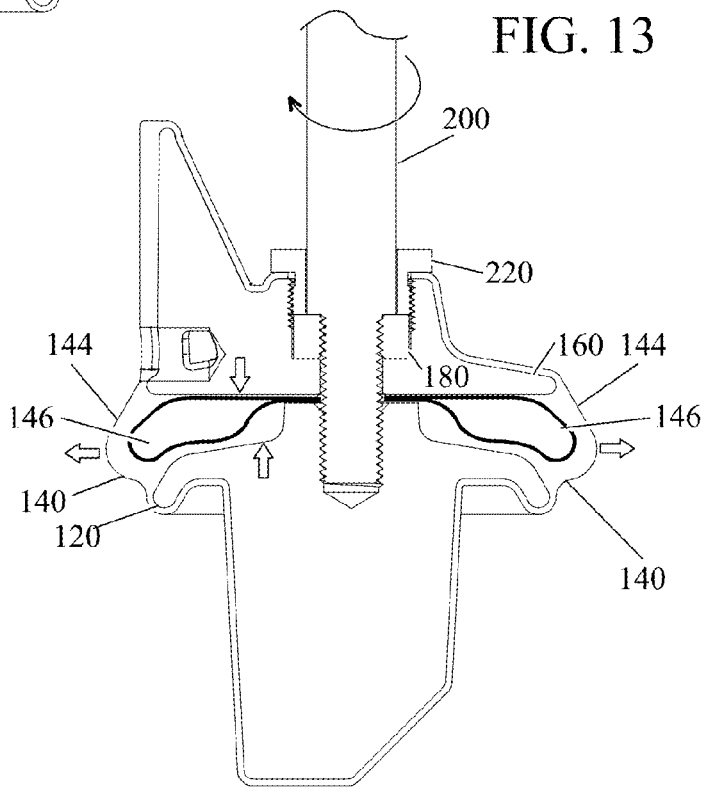
FIG. 13 shows an alternate embodiment of a main valve seal that has a core molded into it, after compression between a main valve bottom plate and drain valve body.

In some embodiments, shown in FIGS. 4-11 for example, the main valve seal 140 may be formed from the same elastomer material throughout its volume. In alternate embodiments, shown in FIGS. 12-13 for example, a core 146 may be inserted into the mold between the drain valve body 160 and the main valve bottom plate 120 during molding of the main valve assembly (main valve bottom plate 120, main valve seal 140, and drain valve body 160).

The core 146 may be made from a material having a different modulus of elasticity than the material from which the main valve seal 140 will be formed. Using a material with a lower modulus of elasticity in the core 146, for example, the main valve seal 140 may be inhibited from compressing to a degree in various locations, biasing the main seal 140 to form a desired cross sectional profile in compression through elastic deformation. Conversely, using a core 146 with a higher modulus of elasticity than the main seal 140 may encourage compression and elastic deformation in various locations, also biasing the main valve seal 140 to form a given cross-sectional profile in compression. Cores 142 having a higher modulus of elasticity, lower modulus of elasticity, or combinations thereof at different locations in their construction may be employed to optimally bias the main valve seal 140 to elastically deform in a desired manner with minimum force while maintaining the strength of the main valve seal 140, whether through compression or tension.

FIGS. 15-20 show an alternate embodiment of a main valve assembly, including a drain valve body 160, main valve seal 140, and main valve bottom plate 120, and elbow 100. Generally, the construction and operation of the main valve assembly are as previously described herein, with the main valve seal 140 being bonded to both the drain valve body 160 and the main valve bottom plate 120. However, in this embodiment the blade 122 and elbow 100 plates 110 which keep the main valve assembly from rotating have been removed from the main valve bottom plate 120 and the elbow 100, respectively. Instead, as shown FIGS. 15-20, a second slide 300 has been added to the drain valve body 160 and acts as a rotation lock. Additionally, a pair of slots 320 is formed in the channel 107 in the top of the elbow 100 to receive the second slide 300 and the drain valve slide 168, and act as rotation blocks.

Figure 17:
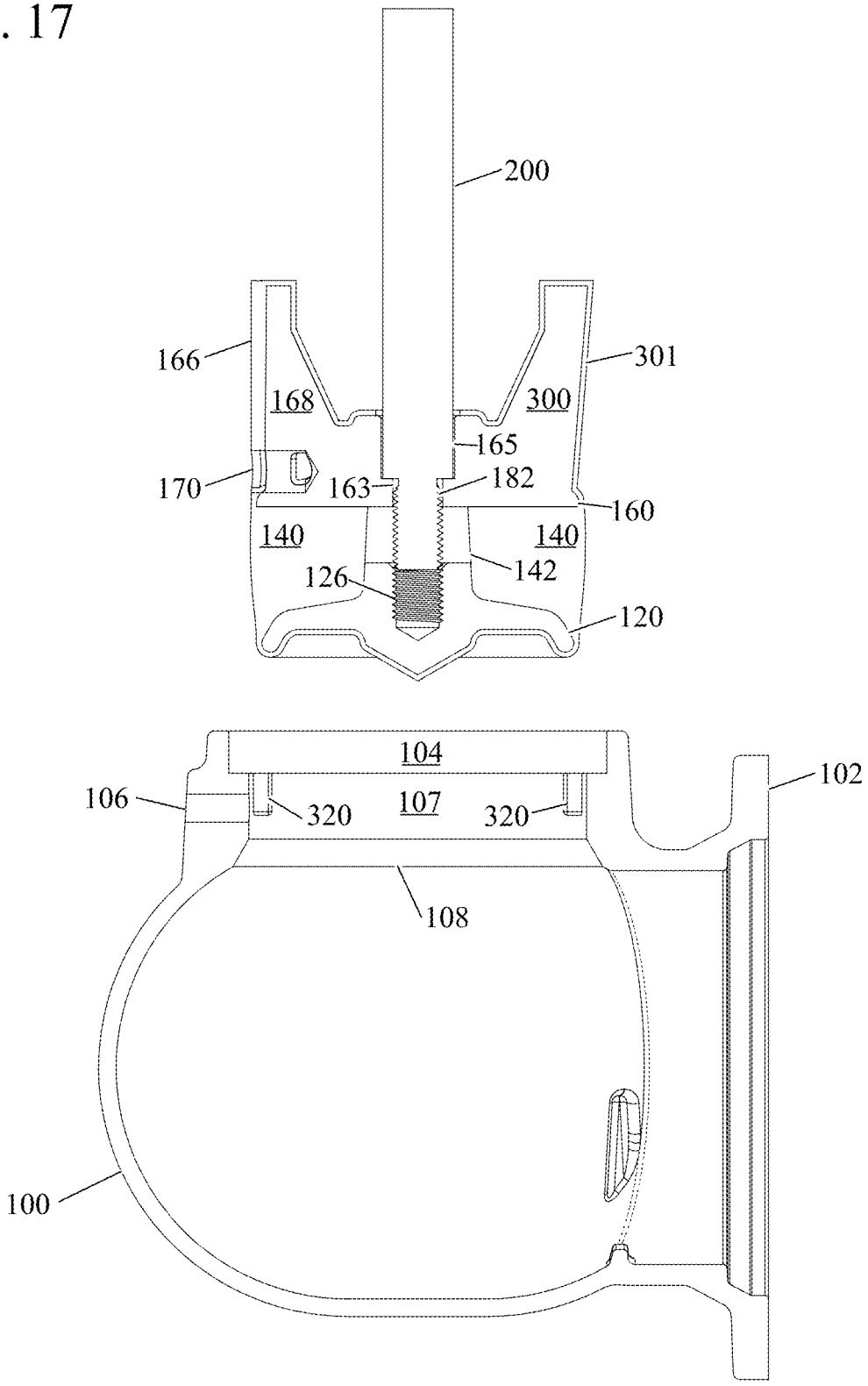
FIG. 17 shows a main valve assembly having a drain valve body with slides coupled to an operating stem prior to insertion into an elbow having slots for receiving drain valve body slides.
Figure 18:
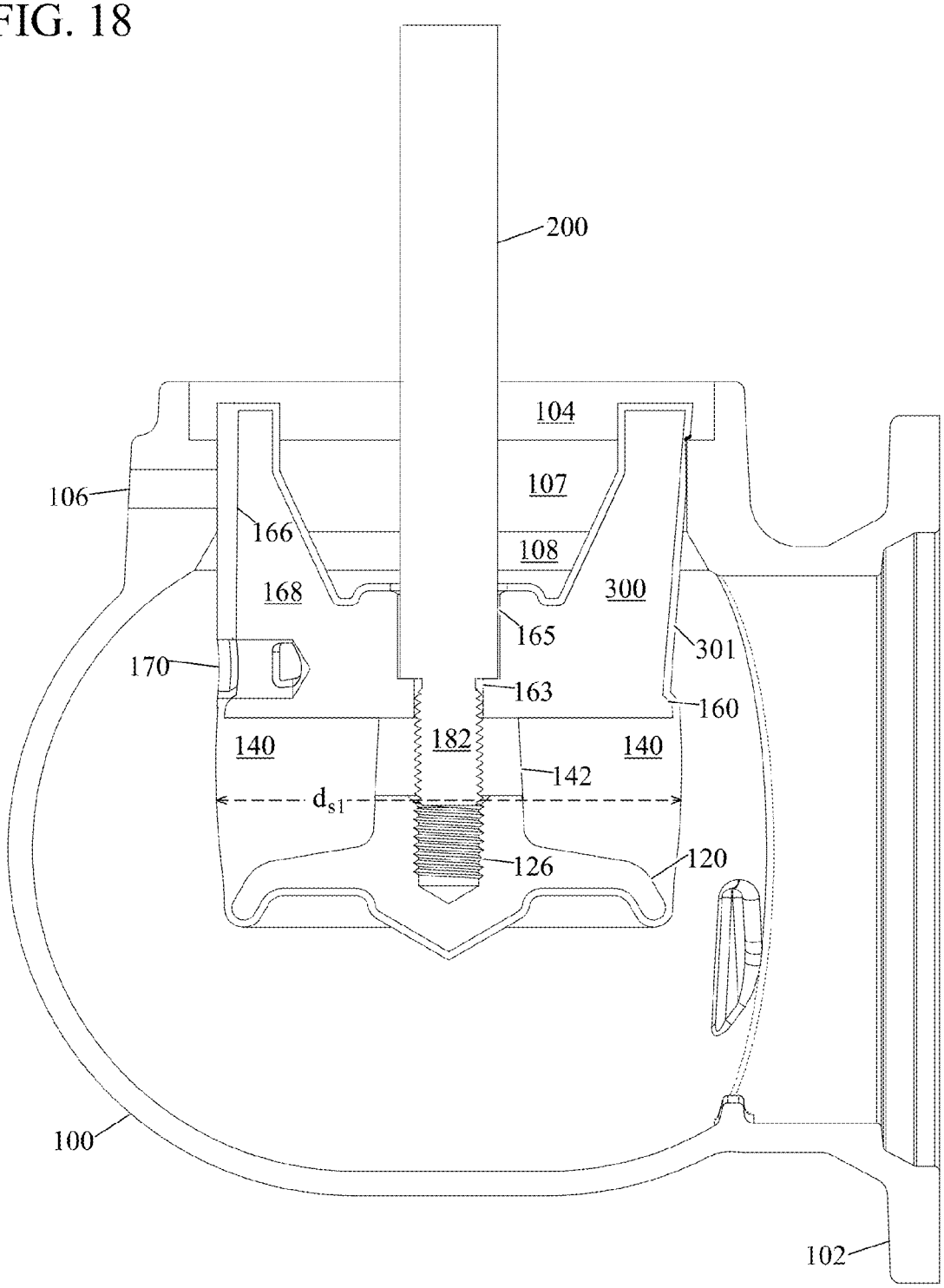
FIG. 18 shows a main valve assembly having a drain valve body with slides coupled to an operating stem after insertion into an elbow having slots for receiving drain valve body slides.
Figure 19:
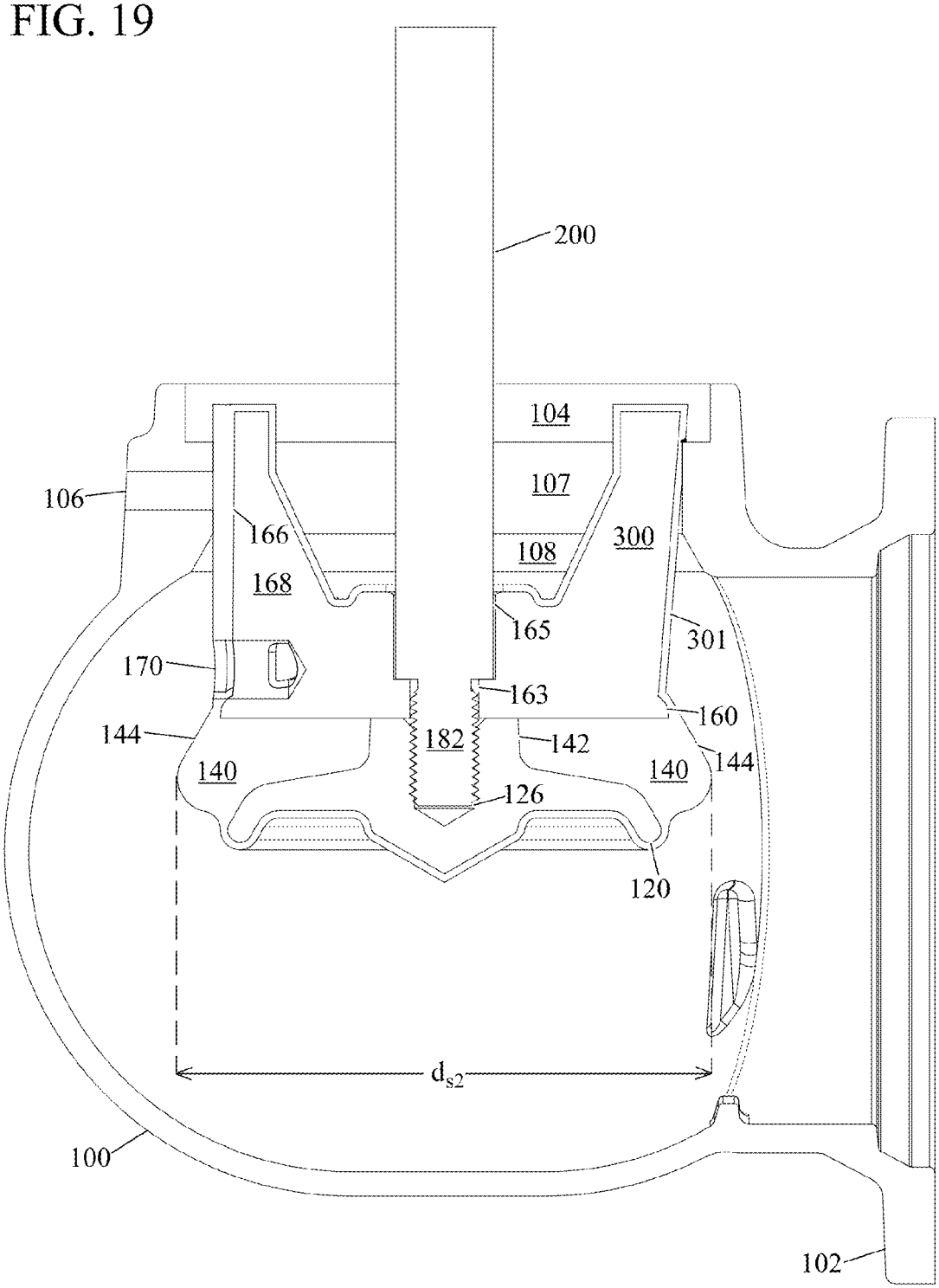
FIG. 19 shows a main valve assembly having a drain valve body with slides coupled to an operating stem after insertion into an elbow having slots for receiving drain valve body slides and deformation of the main valve seal, with the main valve assembly in an open position.

As shown in FIGS. 18-19, when the main valve assembly (including the drain valve body 160, the main valve seal 140, and the main valve bottom plate 120) is inserted through the channel 107 into the elbow 100, the drain valve slide 168 and second slide 300 are received in the slots 320 (shown in FIGS. 15-17) in the channel 107, and the drain valve body 160 is prevented from rotating when the operating stem extension 200 is rotated. As the main valve seal 140 is bonded to the drain valve body 160, and the main valve bottom plate 120 is bonded to the main valve seal 140, they are similarly prevented from rotating when the operating stem extension 200 is rotated.

Figure 16:
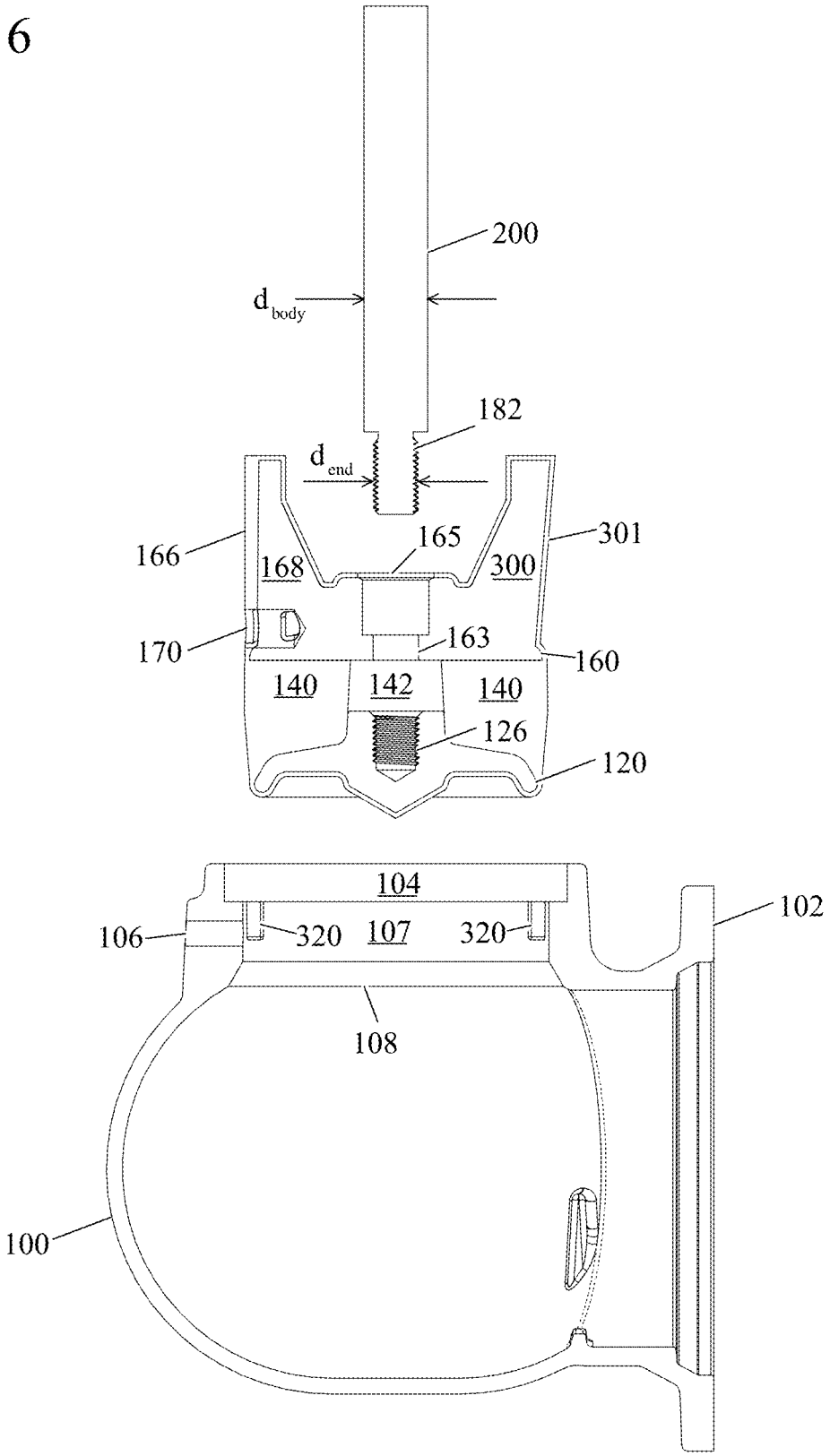
FIG. 16 shows an exploded view of a main valve assembly having a drain valve body with slides and an elbow having slots for receiving drain valve body slides.

Referring now to FIG. 16, the components of the main valve are shown prior to assembly. The operating stem extension 200 is provided with a threaded end 182 that has a smaller diameter, $d_{end}$, than the body of the operating stem 200, $d_{body}$. In contrast to previous embodiments, the drain valve body 160 is provided with a central aperture comprising an upper portion 165 for accepting the operating stem extension 200, and a lower portion 163 through which the operating stem extension 200 threaded end 182 may pass. Thus, the drain valve body 160 is prevented from moving upwardly on the operating stem extension 200 and is held on the operating stem 200 from below by the main valve seal 140 and the main valve bottom plate 120. As shown in FIG. 17, when initially assembled, the operating stem 200 threaded end 182 passes through the main valve seal 140 central passage 142 and mates with the threaded hole 126 in the main valve bottom plate 120.

As in the previous embodiment, the drain valve body 160 is coupled to the operating stem extension 200 so that the position of the drain valve body 160 longitudinally on the operating stem extension 200 is fixed. Also, the main valve bottom plate 120 is coupled to the operating stem extension 200 so that the longitudinal position of the main valve bottom plate 120 on the operating stem extension 200 may change when the operating stem extension 200 is rotated. Hence, rotating the operating stem 200 will cause the main valve bottom plate 120 to move relative to the drain valve body 160, compressing the main valve seal 140 and causing main valve seal 140 to elastically deform from the first state with a diameter, $d_{s1}$, shown for example FIG. 18, to the second state with a main seal surface 144 and a diameter, $d_{s2}$, shown for example in FIG. 19.

It is understood that the thrust bearing 180 and retaining nut 220 arrangement shown and described in FIGS. 4-14 is equally applicable to the embodiments shown FIGS. 15-20, allowing elastic deformation of the main valve seal 140 through either compression or tension between the main valve bottom plate 120 and the drain valve body 160. It is further understood that alternative coupling mechanisms between the operating stem extension 200 and main valve bottom plate 120, and the drain valve body 160 and the operating stem extension 200, may also permit the distance between the main valve bottom plate 120 and the drain valve body 160 to be changed and are also considered to be within the scope of this disclosure.

Figure 20:
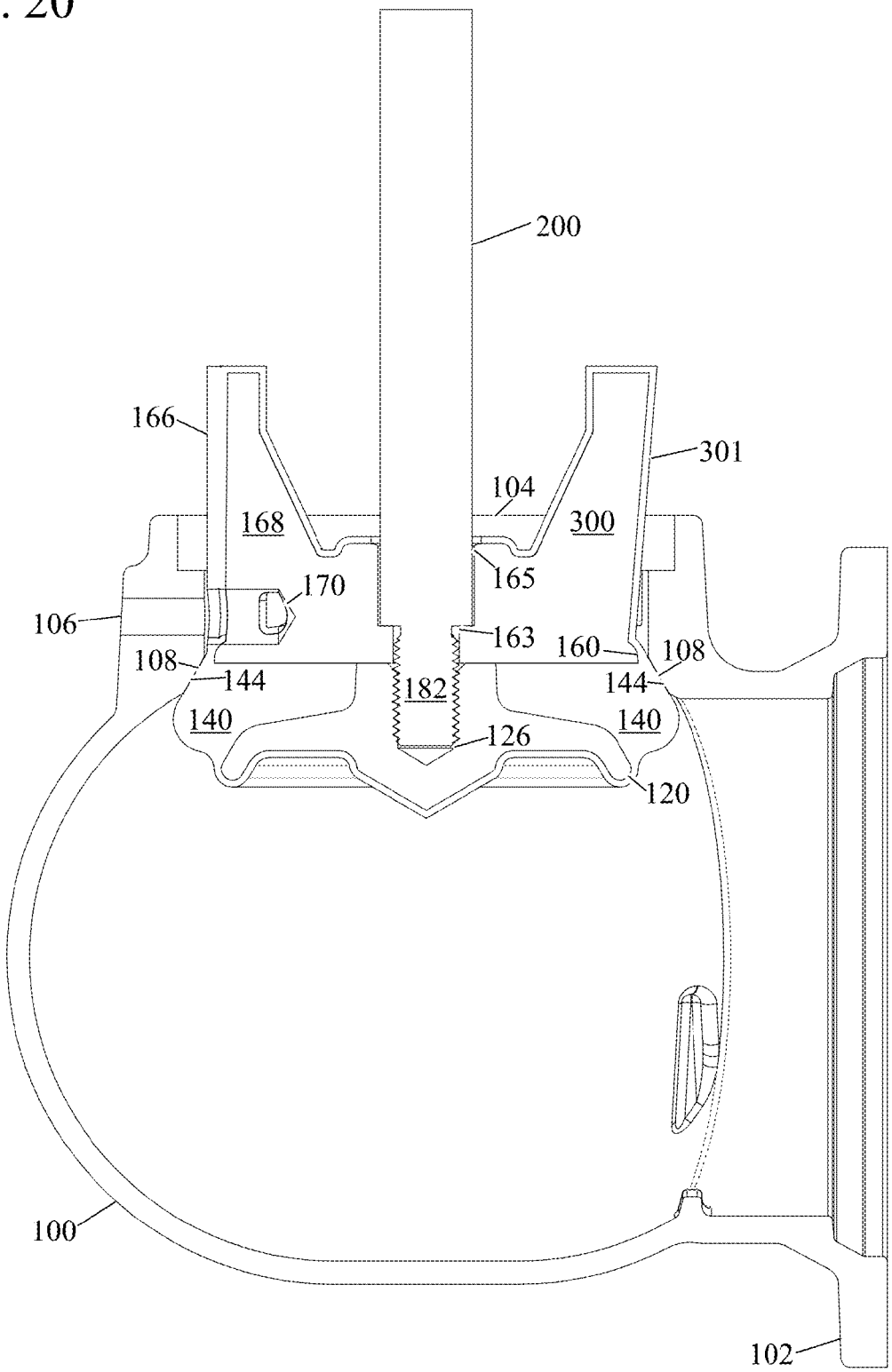
FIG. 20 shows a main valve assembly having a drain valve body with slides coupled to an operating stem after insertion into an elbow having slots for receiving drain valve body slides, with the main valve assembly in a closed position.

FIGS. 15-20 also illustrate an alternate embodiment for biasing the drain valve slide 168 and drain valve facing 166 toward the elbow 100 drain hole 106, and creating a positive seal between the drain valve facing 166 and the drain hole 106, when the main valve is opened. As shown in FIG. 19, for example, the second slide 300 on the drain valve body 160 has a side 301 that slants outwardly toward the elbow 100 and elbow channel 107 at the top of the second slide 300 and acts as a first wedge element. Thus, as shown in FIG. 20, when the main valve assembly is in an upper, "closed" position, the main valve seal 140 is self-centering and the main valve seal surface 144 makes positive contact with the valve seat 108. In this position, the drain valve port 170 is also aligned with the elbow 100 drain hole 106, allowing water in the upper barrel 10 and lower barrel 20 to drain when the main valve is closed.

When the main valve assembly is lowered into an open position, as shown for example in FIG. 19, the second slide 300 slanted side 301 acting as a first wedge element is forced against one side of the channel 107 (and slot 320 forming an interior surface of the elbow 100) in the elbow 100, and biases the drain valve body 160 laterally toward the opposite side of the channel 107. The drain valve slide 168 riding in a slot 320 on this opposite side of the channel 107 is thus actively forced toward the drain hole 106, so that the drain valve facing 166 is pressed firmly against the drain hole 106 and provides a positive seal.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A main valve for regulating a flow of water from a water main pipe through a flange, to a hydrant having a barrel and an operating stem having a lower end, the main valve including an elbow having a hollow body with an opening in a side surrounded by a flange for mating to the flange of the water main pipe and a channel in a top of the elbow for mating with a lower end of the barrel; a lower extent of the channel in the top of the elbow being chamfered to form a valve seat; the main valve comprising:

a) a main valve assembly, comprising;

i) a drain valve body having a central aperture through which the lower end of operating stem passes, the operating stem being rotatable relative to the drain valve body, the central aperture being configured such that the drain valve body is longitudinally fixed to the lower end of the operating stem;

ii) a main valve bottom plate coupled to the lower end of the operating stem such that rotation of the operating stem causes the main valve bottom plate to move longitudinally relative to the drain valve body;

iii) a main valve seal formed of an elastomer having an upper surface bonded to the drain valve body and a lower surface bonded to the main valve bottom plate, such that as the main valve bottom plate moves longitudinally relative to the drain valve body, the main valve seal is deformed from a first state with a first diameter which is less than both a diameter of the barrel and of a diameter of the channel in the top of the elbow such that when the main valve seal is in the first state, the main valve assembly may pass through the barrel and the channel in the top of the elbow, to a second state with a second diameter greater than the diameter of the channel in the top of the elbow such that the main valve seal seals against the valve seat; and b) a rotation lock fixed to the main valve assembly; and c) a rotation block inside the hollow body of the elbow engaging the rotation lock, preventing rotation of the main valve assembly relative to the elbow;

such that when the operating stem is rotated the contact of the rotation block and the rotation lock prevents rotation of the main valve assembly, causing the main valve bottom plate to move longitudinally relative to the drain valve body.

2. The main valve of claim 1, wherein the rotation block of the elbow is a blade guide inside the body of the elbow, and the rotation lock of the main valve assembly is a blade extending downwardly from a bottom of the main valve bottom plate into the elbow body adjacent the blade guide of the elbow.

3. The main valve of claim 1, wherein the rotation lock of the main valve assembly is a slide extending upwardly from a top of the drain valve body, and the rotation block of the elbow is a slot inside the body of the elbow for receiving the slide of the drain valve body.

4. The main valve of claim 1, wherein the lower end of the operating stem is threaded, and the drain valve body further comprises a thrust rotatably received within the central aperture of the drain valve body, threaded on the lower end of the operating stem; and a retaining nut fixed to the drain valve body around the operating stem above the thrust bearing.

5. The main valve of claim 1, wherein the central aperture of the drain valve body has an upper section having a first diameter and a lower section having a second diameter smaller than the first diameter; and an upper section of the operating stem has a third diameter smaller than the first diameter and larger than the second diameter, and the lower end of the operating stem has a fourth diameter smaller than the second diameter.

6. The main valve of claim 1, wherein the main valve bottom plate is coupled to the operating stem by a threaded lower end of the operating stem threading into a threaded hole in the main valve bottom plate.

7. The main valve of claim 1, wherein the main valve seal in the second state is compressed between the drain valve body and the main valve bottom plate.

8. The main valve of claim 1, wherein the main valve seal in the first state is held in tension between the drain valve body and the main valve bottom plate.

9. The main valve of claim 1, wherein the main valve seal comprises an external volume made of an elastomer with a first modulus of elasticity, and a core made of an elastomer with a different modulus of elasticity than the first modulus of elasticity.

10. The main valve of claim 1, further comprising an elastomer bonded to an external surface of the drain valve body.

11. The main valve of claim 1, further comprising an elastomer bonded to an external surface of main valve bottom plate.

12. The main valve of claim 1, wherein the drain valve body and the main valve seal upper surface are bonded by a rubber tearing bond.

13. The main valve of claim 1, wherein the main valve seal bottom surface and main valve bottom plate are bonded by a rubber tearing bond.

* * * * *